US009932786B2

(12) United States Patent
Chambers et al.

(10) Patent No.: US 9,932,786 B2
(45) Date of Patent: Apr. 3, 2018

(54) MISALIGNMENT MITIGATION IN A ROTATING CONTROL DEVICE

(71) Applicant: Weatherford Technology Holdings, LLC, Houston, TX (US)

(72) Inventors: James W. Chambers, Houston, TX (US); Danny W. Wagoner, Waller, TX (US); Andrew Harrison, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 370 days.

(21) Appl. No.: 14/725,291

(22) Filed: May 29, 2015

(65) Prior Publication Data

US 2015/0345236 A1 Dec. 3, 2015

Related U.S. Application Data

(60) Provisional application No. 62/004,624, filed on May 29, 2014.

(51) Int. Cl.

| | |
|---|---|
| ***E21B 19/24*** | (2006.01) |
| ***E21B 33/08*** | (2006.01) |
| ***E21B 21/08*** | (2006.01) |

(52) U.S. Cl.

CPC ..... *E21B 19/24* (2013.01); *E21B 21/08* (2013.01); *E21B 33/085* (2013.01)

(58) Field of Classification Search

CPC ..... E21B 33/085; E21B 19/02; E21B 19/16; E21B 19/24; E21B 21/08; E21B 21/106; E21B 33/06

See application file for complete search history.

(56) References Cited

U.S. PATENT DOCUMENTS

| | | | |
|---|---|---|---|
| 5,647,444 | A | 7/1997 | Williams |
| 5,662,181 | A | 9/1997 | Williams et al. |
| 6,138,774 | A | 10/2000 | Bourgoyne, Jr. et al. |
| 6,263,982 | B1 | 7/2001 | Hannegan et al. |
| 6,725,938 | B1 | 4/2004 | Pietras |
| 7,159,669 | B2 | 1/2007 | Bourgoyne et al. |
| 7,926,593 | B2 | 4/2011 | Bailey et al. |

(Continued)

FOREIGN PATENT DOCUMENTS

WO 2013160672 A2 10/2013

OTHER PUBLICATIONS

Australian Examination Report dated Jan. 3, 2017 for AU Patent Application No. 2015266783, 3 pages.

(Continued)

*Primary Examiner* — Daniel P Stephenson
(74) *Attorney, Agent, or Firm* — Smith IP Services, P.C.

(57) ABSTRACT

The exemplary embodiments relate to misalignment correction devices and methods for mitigating misalignment of a piece of oilfield equipment in or proximate an RCD. A rounded shoulder appears on a first surface within or proximate the RCD, and a socket profile appears on a second surface within or proximate the RCD. The second surface is configured to abut the rounded shoulder. The rounded shoulder is configured to rotate within the socket profile. Further, a floating joint may be implemented into or proximate the RCD and combined with the foregoing rotation mitigation features.

26 Claims, 21 Drawing Sheets

(56) References Cited

U.S. PATENT DOCUMENTS

| | | | | |
|---|---|---|---|---|
| 8,286,734 | B2 * | 10/2012 | Hannegan | E21B 7/02 166/84.1 |
| 2011/0036638 | A1 | 2/2011 | Sokol | |
| 2013/0341052 | A1 | 12/2013 | Bailey et al. | |
| 2015/0285013 | A1 * | 10/2015 | Johnson | E21B 17/00 166/381 |
| 2015/0345236 | A1 * | 12/2015 | Chambers | E21B 19/24 166/381 |

OTHER PUBLICATIONS

International Search Report with Written Opinion dated Oct. 29, 2015 for PCT Patent Application No. PCT/US2015/033209, 11 pages.
Singapore Office dated Sep. 26, 2017 for SG Patent Application No. 11201609034R, 7 pages.
Canadian Office Action dated Oct. 23, 2017 for CA Patent Application No. 2,946,005, 4 pages.

* cited by examiner

MISALIGNMENT MITIGATION IN A ROTATING CONTROL DEVICE

CROSS-REFERENCE TO RELATED APPLICATIONS

This application claims the benefit of U.S. Provisional Application No. 62/004,624 filed May 29, 2014 the disclosure of which is hereby incorporated by reference.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND

Technical Field

The exemplary embodiments relate to techniques and apparatus for misalignment mitigation of downhole tools in a wellbore.

Oilfield operations may be performed in order to extract fluids from the earth. When a well site is completed, pressure control equipment may be placed near the surface of the earth including in a subsea environment. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe, casing, drill collars, kelly, etc.) for the purposes of controlling the pressure or fluid flow to the surface. The RCD may have multiple seal assemblies and, as part of a seal assembly, may have two or more seal elements in the form of stripper rubbers for engaging the drill string and controlling pressure up and/or downstream from the stripper rubbers. For reference to existing descriptions of rotating control devices and/or for controlling pressure please see U.S. Pat. Nos. 5,662,181; 6,138,774; 6,263,982; 7,159,669; and 7,926,593 the disclosures of which are hereby incorporated by reference.

Misalignment of the drill string to the wellbore is an ongoing problem for RCDs. Excessive misalignment can cause sealing element failures, and if severe enough, damage to bearing assemblies and RCD bodies. Historically, the problem has been addressed by making adjustments to the drilling rig, however, there are some situations where rig alignment is not constant, and alignment changes with the amount of pipe that is in the pipe rack. In addition, rig adjustments require personnel to monitor the alignment and adjust accordingly. Perception on alignment may also be an issue. Thus, there is a need for improved misalignment correction techniques, particularly passive techniques.

SUMMARY

The disclosure relates to misalignment correction devices and methods for mitigating misalignment of a piece of oilfield equipment in an RCD. A rounded shoulder appears on a first surface within the RCD, and a socket profile appears on a second surface within the RCD. The second surface is configured to abut the rounded shoulder. The rounded shoulder is configured to rotate within the socket profile. Further, a floating joint may be implemented into the RCD and combined with the foregoing rotation mitigation features.

As used herein the terms "radial", "radially", "horizontal" and "horizontally" include directions inward toward the center axial direction of the drill string but not limited to directions perpendicular to such axial direction or running directly through the center. Rather such directions, although including perpendicular and toward the center, also include those transverse and/or off center yet moving inward, across or against the surface of an outer sleeve.

As used herein the terms "rounded" and "spherical" shall include arcuate, ovoid and elliptical.

As used herein the terms "anti-rotational device" shall include a J-latch, an annular bladder, an inflatable (or other type) clutch and/or a key or pin in combination with a mating slot.

BRIEF DESCRIPTION OF THE DRAWINGS

The exemplary embodiments may be better understood, and numerous objects, features, and advantages made apparent to those skilled in the art by referencing the accompanying drawings. These drawings are used to illustrate only exemplary embodiments of this disclosure, and are not to be considered limiting of its scope, for the disclosure may admit to other equally effective exemplary embodiments. The figures are not necessarily to scale and certain features and certain views of the figures may be shown exaggerated in scale or in schematic in the interest of clarity and conciseness.

DESCRIPTION OF EXEMPLARY EMBODIMENT(S)

The description that follows includes exemplary apparatus, methods, techniques, and instruction sequences that embody techniques of the disclosed subject matter. However, it is understood that the described exemplary embodiments may be practiced without these specific details.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the disclosed subject matter.

Figure 1A:
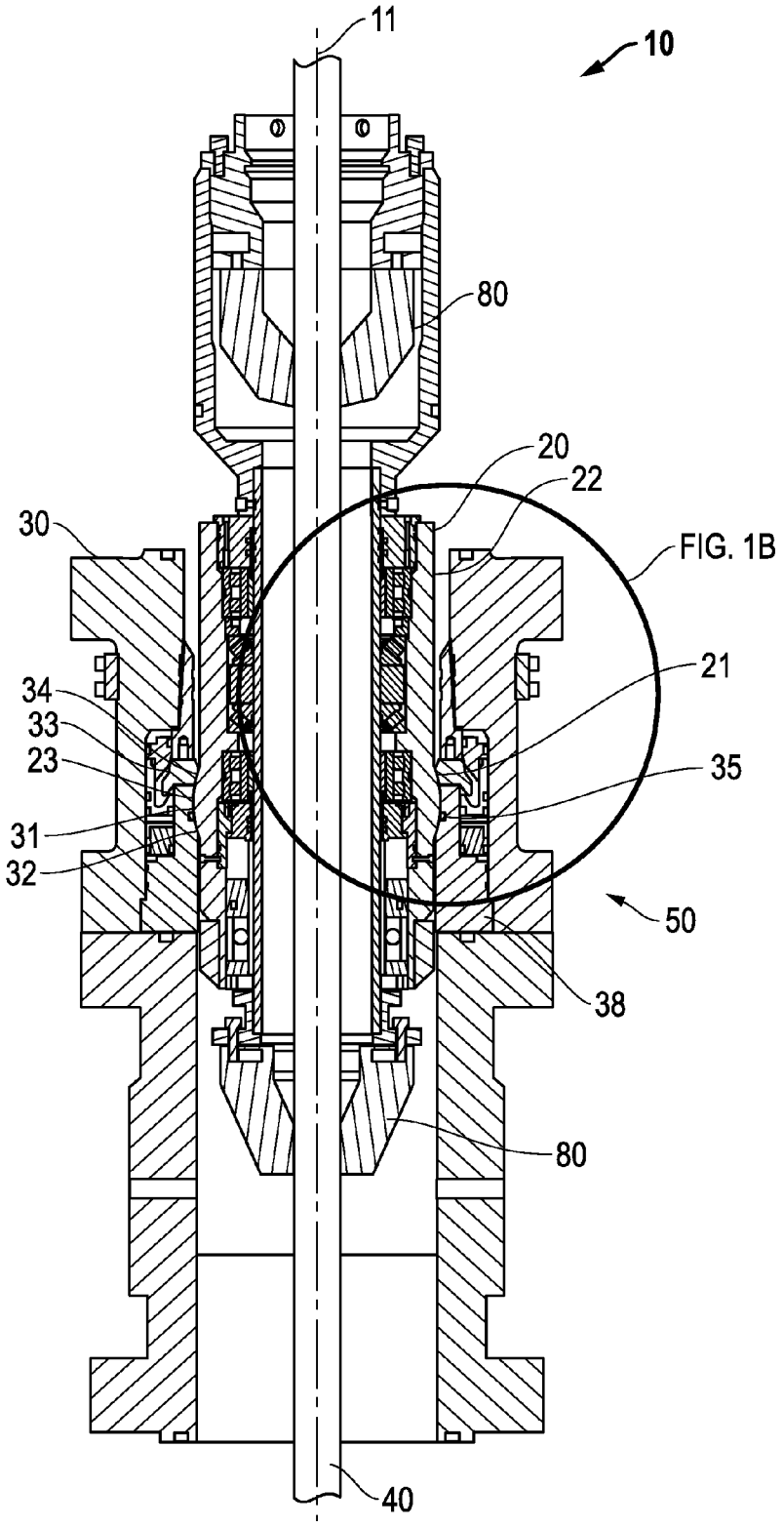
FIG. 1A depicts a cross-section of an RCD and an aligned piece of oilfield equipment with an exemplary embodiment of a misalignment mitigation or correction device.
Figure 1B:
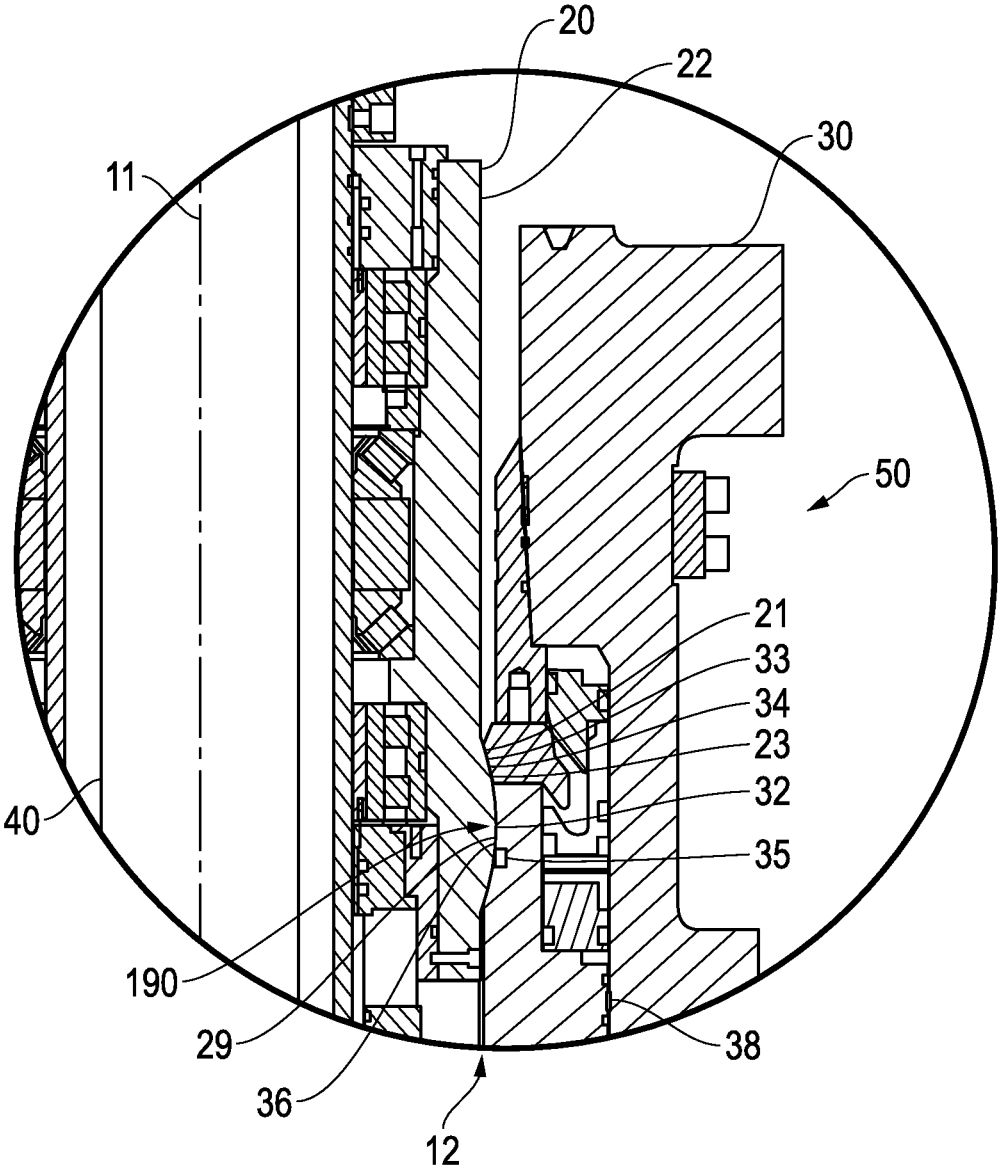
FIG. 1B depicts an enlarged view taken from FIG. 1A.
Figure 1C:
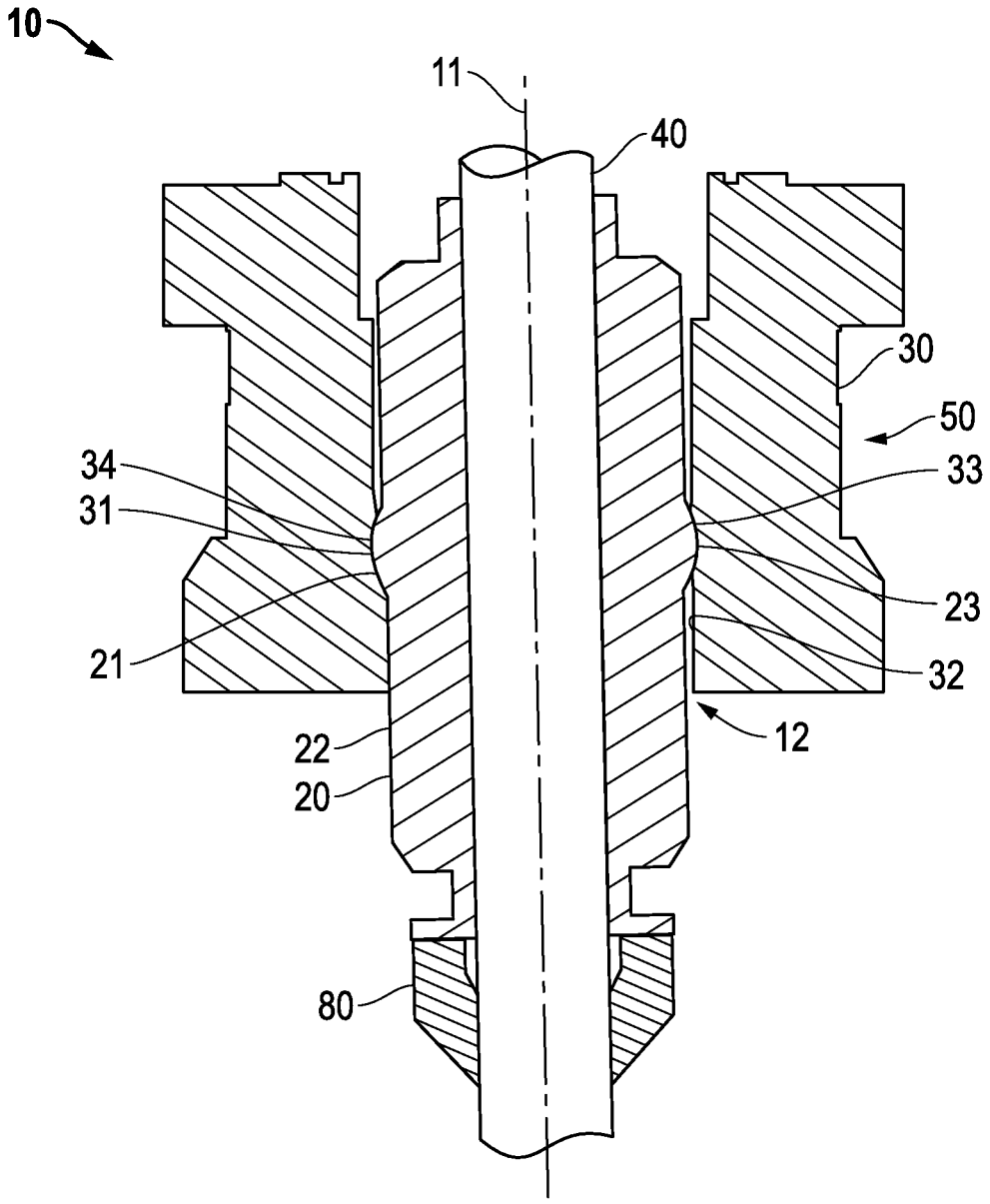
FIG. 1C depicts a cross-section of an RCD and a misaligned piece of oilfield equipment with an exemplary embodiment of a misalignment correction device.

FIGS. 1A and 1B depict a cross-section of an RCD 10 and an aligned piece of oilfield equipment 40 with an exemplary embodiment of a misalignment mitigation or correction device 50; FIG. 1C depicts a cross-section of an RCD 10 and a misaligned piece of oilfield equipment 40 with an exemplary embodiment of a misalignment correction device 50. The RCD 10 (not fully shown but incorporated by reference) has one or more sealing elements 80 for sealing an item of oilfield equipment 40 at a wellsite (not shown but incorporated by reference) proximate a wellbore (not shown but incorporated by reference) (or in a marine environment above and/or below the water; or for directional drilling under an obstacle) formed in the earth and lined with a casing. The one or more RCDs 10 may control pressure in the wellbore. Typically, an internal portion of the RCD 10 is designed to seal around a piece of oilfield equipment 40 and rotate with the oilfield equipment 40 by use of an internal sealing element 80, a latch assembly 30 and a rotating bearing assembly 20. The sealing elements 80 are shown and described herein as being located in an RCD 10 (rotational control device). The one or more sealing elements 80 may be one or more annular stripper rubbers, or sealing elements 80, located within the RCD 10. The sealing elements 80 may be configured to radially engage and seal the oilfield equipment 40 during oilfield operations. Additionally, the internal portion of the RCD 10 and bearing assembly 20 permits the oilfield equipment 40 to move axially and slidably through the RCD 10. The oilfield equipment 40 may be any suitable equipment to be sealed by the sealing element 80 including, but not limited to, a drill string, a bushing, a bearing, a bearing assembly, a test plug, a snubbing adaptor, a docking sleeve, a sleeve, sealing elements, a tubular, a drill pipe, a tool joint, or even non-oilfield pieces of equipment such as for directional drilling under obstacles and the like.

The misalignment correction device 50 exemplary embodiment in FIGS. 1A-C includes a spherical (rounded or arcuate) shoulder 21 machined onto the exterior surface 22 of bearing assembly 20 and a matching spherical (socket or arcuate) seat profile 31 machined onto the interior surface 32 of an annular piece 38, which is part of the latch assembly 30. Latch assembly 30 may further include a locking dog 33 which latches onto a matching profile 23 on bearing assembly 20 when in a locked position (as illustrated in FIGS. 1A and 1B). The locking dog 33 retracts into the latch assembly 30 when in the unlocked position. When locking dog 33 is latched, locking dog profile 34, similarly to profile 31 of the annular piece 38, forms a mating complement to profile 23 of the spherical shoulder 21. Further, the annular piece 38 may have a groove including a seal 35 to sealingly engage the spherical shoulder 21.

Figure 8A:
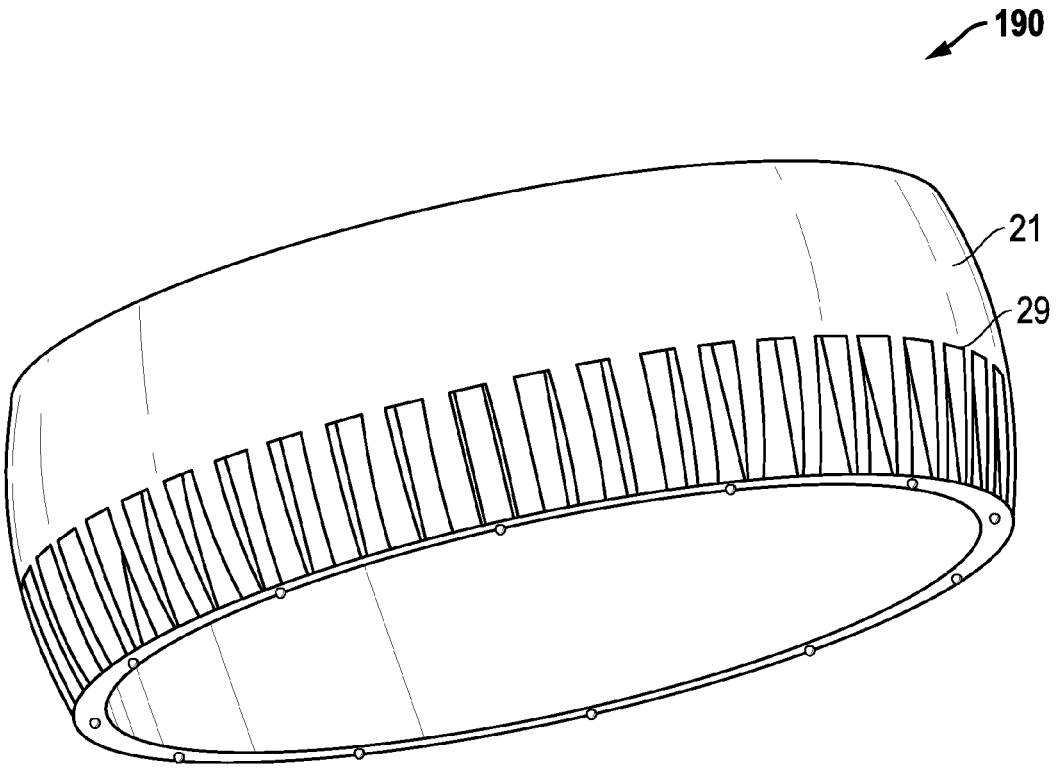
FIG. 8A depicts an exemplary embodiment of the slots of an anti-rotational device.
Figure 8B:
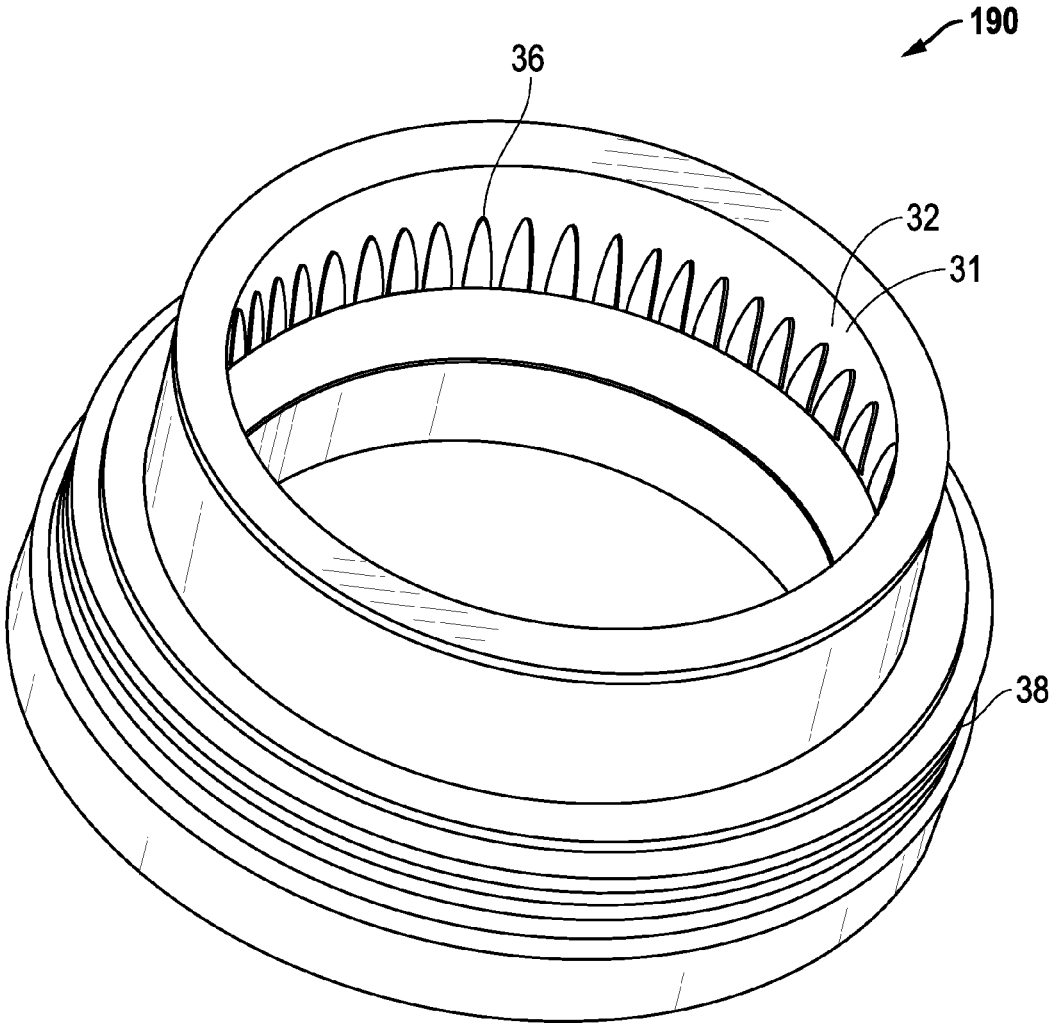
FIG. 8B depicts an exemplary embodiment of the keys corresponding to the slots of the anti-rotational device of FIG. 8A.

The misalignment correction device 50 may also optionally include anti-rotational device(s) 190 to prevent unintentional rotation or spinning within the RCD 10. For instance, one example of an anti-rotational device 190 may be one or more keys 36 on the latch assembly 30 which extend into and engage one or more slots 29 on the bearing assembly 20. The keys 36 engaging the slots 29 may increase the robustness of the connection, inhibit rotation/spinning, and decrease friction and wear between the bearing assembly 20 and the latch assembly 30. The slots 29 may be uncovered/exposed or covered/enclosed. If enclosed, the slots 29 may completely cover the keys 36 in the assembled position thereby reducing the risk of damage to the keys 36 as the RCD 10 performs oilfield operations. An exemplary embodiment of slots 29 of anti-rotational device 190, as defined on spherical shoulder 21, is depicted in FIG. 8A. Accordingly, the slots 29 may be formed in the outer perimeter of the spherical shoulder 21 (optionally integral with the bearing assembly 20). FIG. 8B depicts an exemplary embodiment of keys 36 formed on the interior surface 32 of the annular piece 38 of anti-rotational device 190. The keys 36 of FIG. 8B may engage the slots 29 of FIG. 8A. In another exemplary embodiment, the keys 36 may be located proximate or even on the surface of the locking dog 33 and the slots 29 may be defined on the spherical shoulder 21. Alternatively or additionally, the keys 36 may be located elsewhere on the interior surface 32 of the annular piece 38 (e.g. above the locking dog 33, as part of the locking dog 33, and facing or opposing the bearing assembly) or latch assembly 30, and the slots 29 may be defined in elsewhere on the exterior surface 22 of the bearing assembly 20. The slots may also appear on the annular piece 38 with the corresponding keys appearing on the spherical shoulder 21.

As demonstrated in FIG. 1C, the spherical shoulder 21 and matching profiles 31, 34 of misalignment correction device 50 allow for some rotation about axis 11 to compensate for some rotational or angular misalignment between the RCD 10, bearing assembly 20, latch assembly 30 and piece of oilfield equipment 40. The amount of rotational or angular misalignment that the misalignment correction device 50 is able to compensate for is limited by the clearance or distance defined by annular space 12 between the interior surface 32 of the annular piece 38 and the exterior surface 22 of the bearing assembly 20. Annular space 12 may be increased or decreased as desired for the particular oilfield operation at hand. The compensated misalignment increases the lifespan of seals 80 (see FIG. 1A) and helps to avoid damage to bearing assemblies 20 and RCDs 10.

Figure 2A:
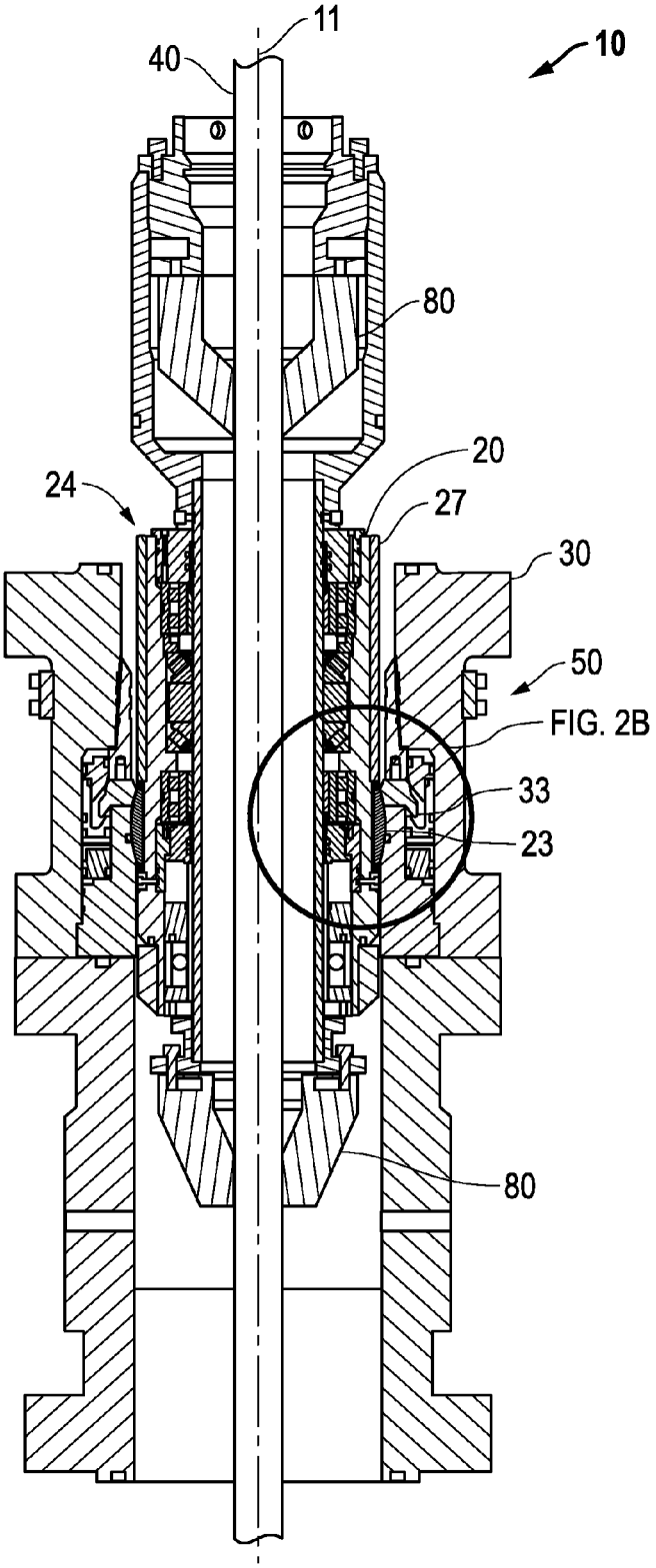
FIG. 2A depicts a cross-section of an RCD with an alternate exemplary embodiment of a misalignment correction device with a sleeve assembly.
Figure 2B:
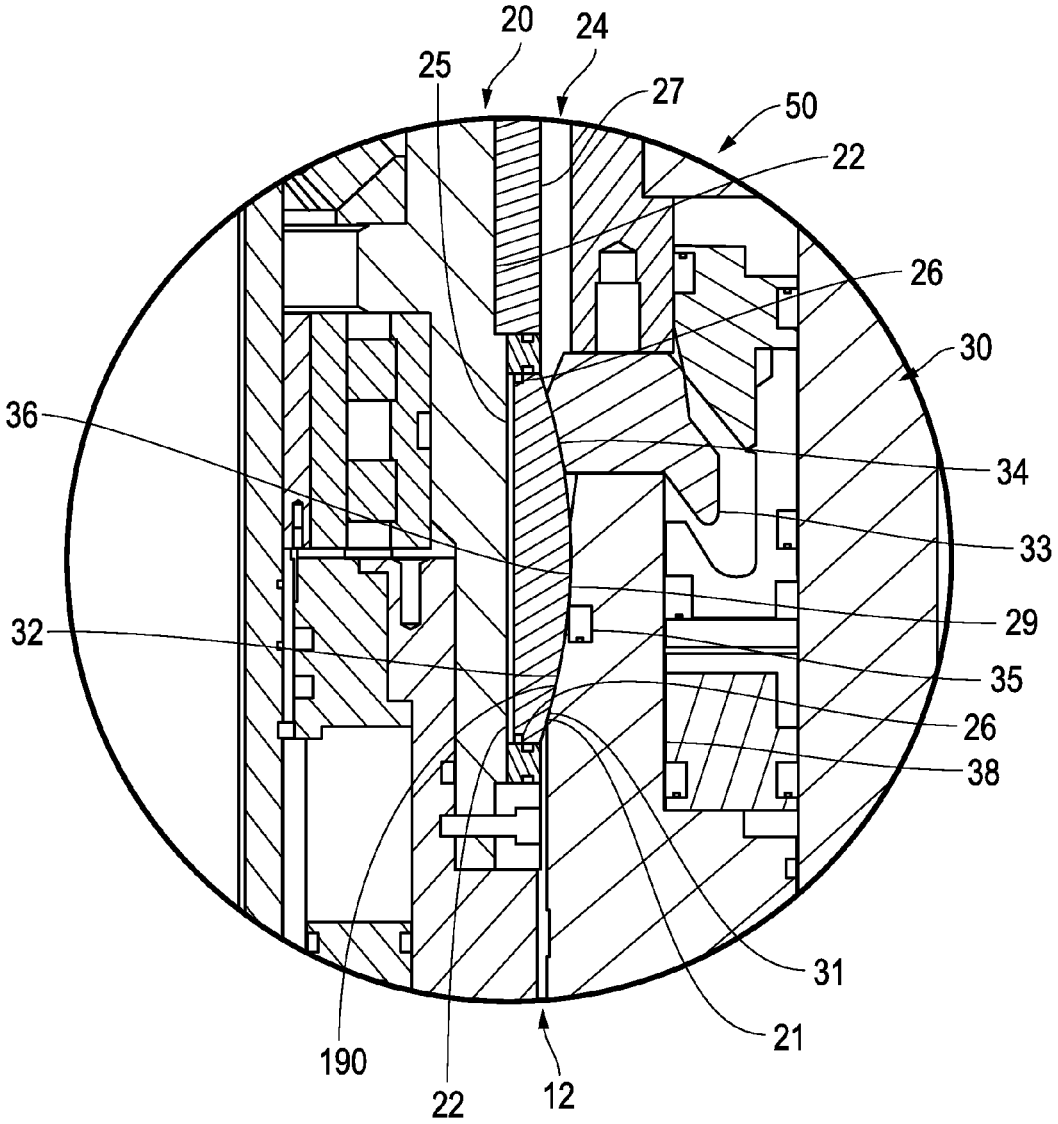
FIG. 2B depicts an enlarged view taken from FIG. 2A.

FIGS. 2A and 2B depict a cross-section of an RCD 10 with an alternate exemplary embodiment of a misalignment correction device 50 with a sleeve assembly 24. For convenience, components in FIGS. 2A and 2B that are similar to components in FIG. 1A-C will be labeled with the same number indicator. In FIGS. 2A-B, the bearing assembly 20 is coupled to a sleeve assembly 24 having a tube or sleeve 27 and a spherical shoulder 21. The sleeve assembly 24 may be coupled to the bearing assembly 20 through bolts, screws, pins, or any other suitable means. While the tube or sleeve 27 lies primarily adjacent to the exterior surface 22 of the bearing assembly 20, the sleeve assembly 24 may have an annular cavity 25 between the spherical shoulder 21 and the bearing assembly 20. Further, the exemplary embodiment may include one or more thrust bearings 26 at an interface where the tube or sleeve 27 is connected to the spherical shoulder 21.

As in FIGS. 1A-C, the latch assembly 30 in FIGS. 2A-B has a matching seat profile 31 machined onto the interior surface 32 of the annular piece 38. The latch assembly 30 also includes a locking dog 33 which latches onto a matching profile 23 on the bearing assembly 20 when in a locked position (as illustrated in FIGS. 2A-B). When locking dog 33 is latched, locking dog profile 34, similar to profile 31 of annular piece 38, forms a mating complement to profile 23 of the spherical shoulder 21. The misalignment correction device 50 exemplary embodiment may also have one or more anti-rotational devices 190 to inhibit unintended rotation or spinning, such as the exemplary embodiment of an anti-rotational device 190 as depicted in FIG. 8A and 8B and described above. Further, the latch assembly 30 may include a seal 35 to sealingly engage the spherical shoulder 21.

In FIGS. 2A-B, the spherical shoulder 21 and matching profiles 31, 34 of misalignment correction device 50 allow for some rotation about axis 11 to compensate for rotational or angular misalignment between the RCD 10, bearing assembly 20, latch assembly 30 and piece of oilfield equipment 40. The exemplary embodiment depicted in FIGS. 2A-B further compensates for horizontal misalignment between the RCD 10, bearing assembly 20, latch assembly 30 and piece of oilfield equipment 40. Movable plates (not illustrated in FIGS. 2A-B but see FIG. 4C and accompanying discussion) on the thrust bearings 26 installed between the spherical shoulder 21 and tube or sleeve 27 enable the misalignment correction device 50 to shift laterally or radially away from axis 11 to compensate for horizontal misalignment. Additional horizontal misalignment compensation may occur through annular cavity 25 and/or annular space 12. The annular space 12, as in the exemplary embodiments shown in FIGS. 1A-C, limits the amount of rotational or angular misalignment that the misalignment device 50 is able to compensate for. Further, the sizes of annular space 12 and annular cavity 25 may be adjusted as desired to meet the needs of the oilfield operation at hand.

Figure 3A:
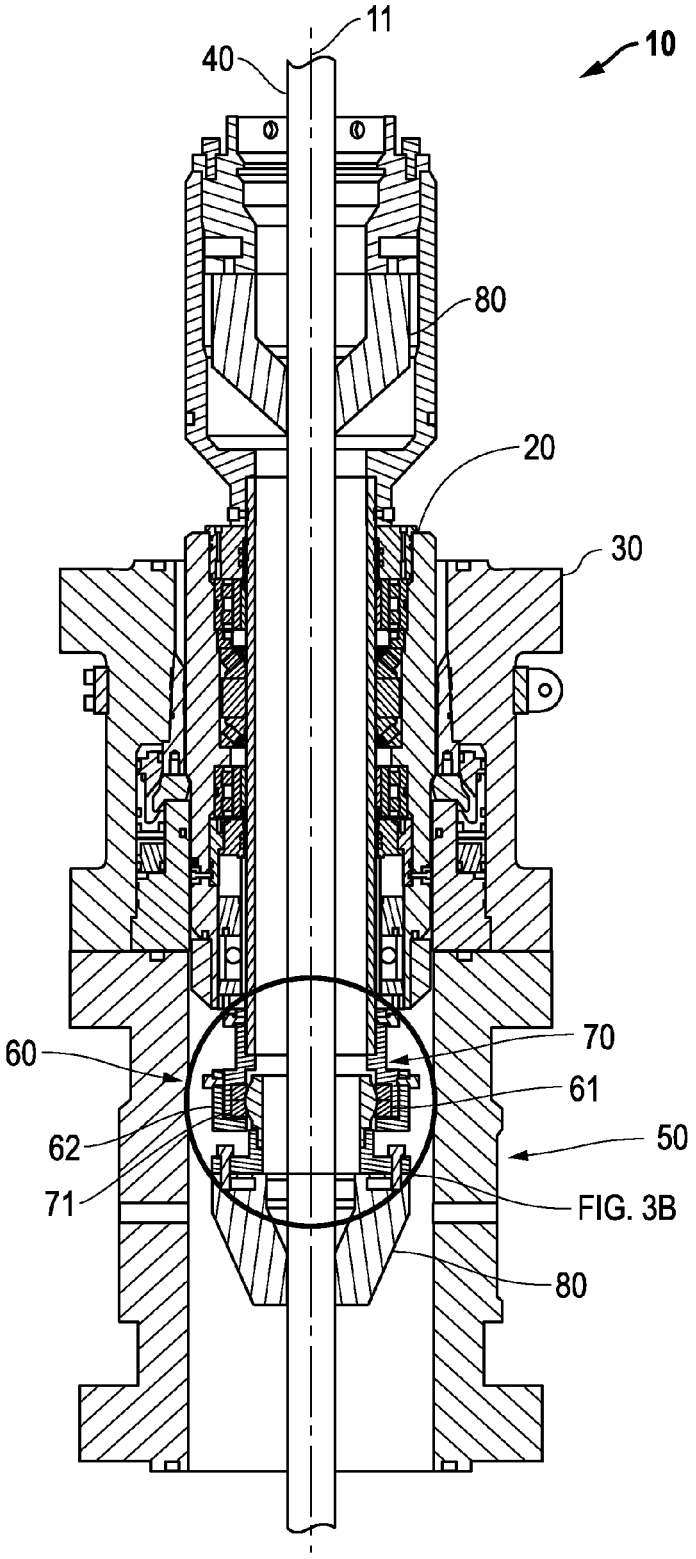
FIG. 3A depicts a cross-section of an RCD with an alternate exemplary embodiment of a misalignment correction device with a carrier and a floating joint.
Figure 3B:
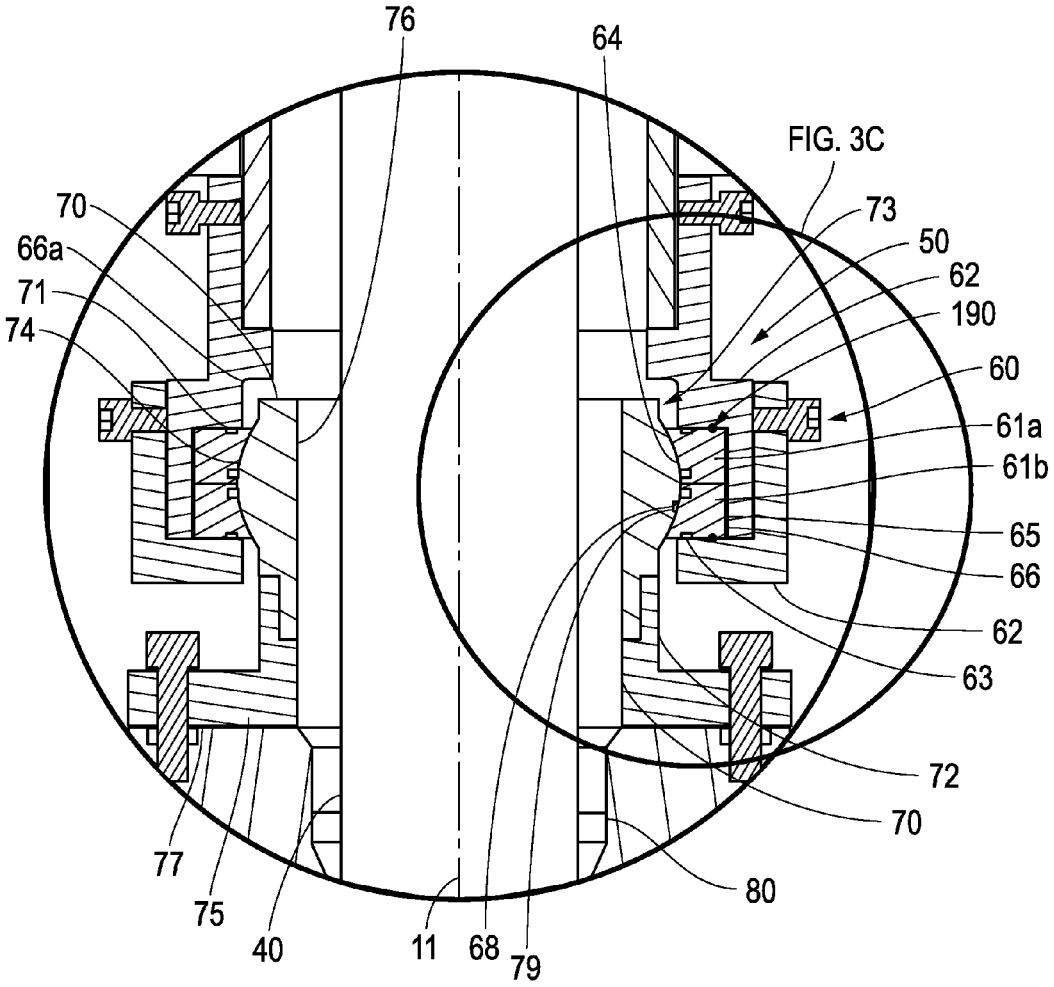
FIG. 3B depicts an enlarged view taken from FIG. 3A.
Figure 3C:
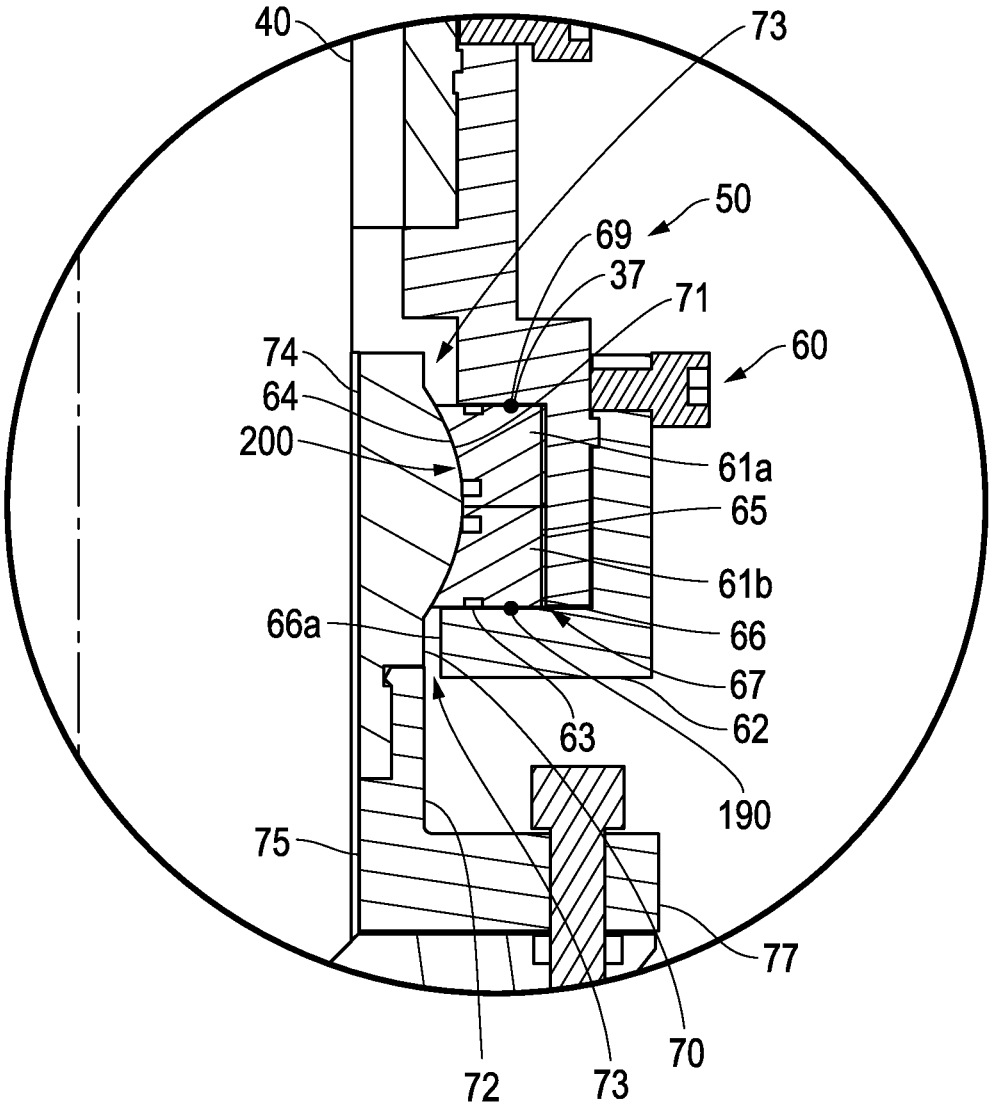
FIG. 3C depicts an enlarged view taken from FIG. 3B.

FIGS. 3A-C depict a cross-section of an RCD 10 with an alternate exemplary embodiment of a misalignment correction device 50 with a carrier 60 and floating joint 70. Carrier 60 is in the form of a housing 62 which support one or more plates 61 and floating joint 70. Further, the housing 62 has an interior wall 66. The carrier 60 may be located below the bearing assembly 20 in the exemplary embodiment illustrated in FIGS. 3A-C, but in other exemplary embodiments the carrier 60 may be located above or within the bearing assembly 20.

The plates 61 are constructed of a nonflexible material such as steel, and have an inner surface 64 and an outer surface 65. While plates 61 are illustrated as an upper plate 61 a and a lower plate 61*b*, any number of plates 61 may be contained in the housing 62. The inner surface 64 of the plates 61 has a socket shape profile 200, and surrounds and engages with the floating joint 70. The outer surface 65 of plates 61 may also define one or more slots 69, to which one or more keys 37, as defined on latch assembly 30, engage. The plates 61, further, may include seals 63 to form fluid tight seals between the top and bottom surfaces of plates 61 that are adjacent to the housing 62 and the inner surface 64 adjacent to the spherical shoulder 71. However, the outer surface 65 of the plate(s) 61 does not fully sit flush against the interior wall 66 of housing 62. Instead, the outer surface 65 of the plates 61 forms a chamber 67 with interior wall 66 of housing 62 inside carrier 60.

The floating joint 70 may be constructed of multiple parts, such as an upper piece 74 and a lower piece 75 which are connected or joined together, as illustrated in FIGS. 3A-C. However, it should be appreciated that the floating joint 70 may also be a singular, unitary piece, or any number of pieces, so long as the features described for both the upper piece 74 and lower piece 75 are present. The floating joint 70 has an exterior surface 72 defining a rounded, spherical shoulder 71, here depicted on the upper piece 74. The upper piece 74 and lower piece 75 together define an inner surface 76 of the floating joint 70. The inner surface 76 establishes a cylindrical space through which the piece of oilfield equipment 40 may travel therethrough. This exemplary embodiment may include anti-rotational device(s) 190. For example, the exterior surface 72 of the floating joint 70 may also have one or more slots 79 (e.g. defined in the face of spherical shoulder 71) which are engaged by one or more keys 68 on the plates 61 (and/or, the keys 68 may be respectively located above and below the plates 61*a* and 61*b* and engage slots respectively in the top of plate 61*a* and in the bottom of plate 61*b*). Keys 68 may be jutted or have two levels for a more secure fit in a mating cavity/slot 79. One exemplary embodiment of the anti-rotational device 190 may be similar to that as reflected in FIGS. 8A and 8B as described above. As discussed above, the lower piece 75 may be connected to the upper piece 74 through means including, but not limited to: bolts, pins, screws or any other suitable means. Further, the lower piece 75 may have a flange 77 to which sealing element 80 is mounted, bonded or bolted to below the floating joint 70. It is to be appreciated that, while the floating joint 70 and carrier 60 is illustrated in FIGS. 3A-C as being below the bearing assembly 20, and above the sealing element 80, the floating joint 70, carrier 60 and sealing element 80 may be located above or within the bearing assembly 20 as well. Any floating joint described herein may also incorporate an expandable bladder-type clutch as an anti-rotational device(s) 190 such as described in U.S. Pat. No. 6,725,938, the disclosure of which, is hereby incorporated by reference.

The spherical shoulder 71 engages with and is supported by the inner surface 64 of the plates 61. In addition, note that while the inner surface 64 of plates 61 may matingly contact with floating joint 70, the interior wall 66*a* of housing 62 does not contact the floating joint 70 while there is no misalignment. In particular, the interior wall 66*a* is arranged such that there is an annular space 73 between the interior wall 66*a* of the housing 62 and the exterior surface 72 of the floating joint 70. This annular space 73 may be increased or decreased as desired for the needs of the particular oilfield operation and exists both above and below the spherical shoulder 71.

As demonstrated in FIGS. 3A-C, the spherical shoulder 71 and inner surface 64 of plates 61 allow for some rotation about axis 11 to compensate for some rotational or angular misalignment between the RCD 10, bearing assembly 20, latch assembly 30 and piece of oilfield equipment 40. Further, the exemplary embodiment depicted in FIGS. 3A-C also compensates for horizontal misalignment between the RCD 10, bearing assembly 20, latch assembly 30 and piece of oilfield equipment 40 through the chamber 67 and annular space 73. The chamber 67 allows the plates 61 to move horizontally across axis 11 to compensate for horizontal misalignment; and annular space 73 also functions similarly to allow floating joint 70 to move, shift or float horizontally across axis 11 to compensate for horizontal misalignment as well. Further and optionally, as anti-rotational device(s) 190, the keys 37, 68 engaging the slots 69, 79 may increase the robustness of the connection, inhibit rotation/spinning, and decrease friction and wear between the latch assembly 30, the floating joint 70, and the plates 61.

Figure 4A:
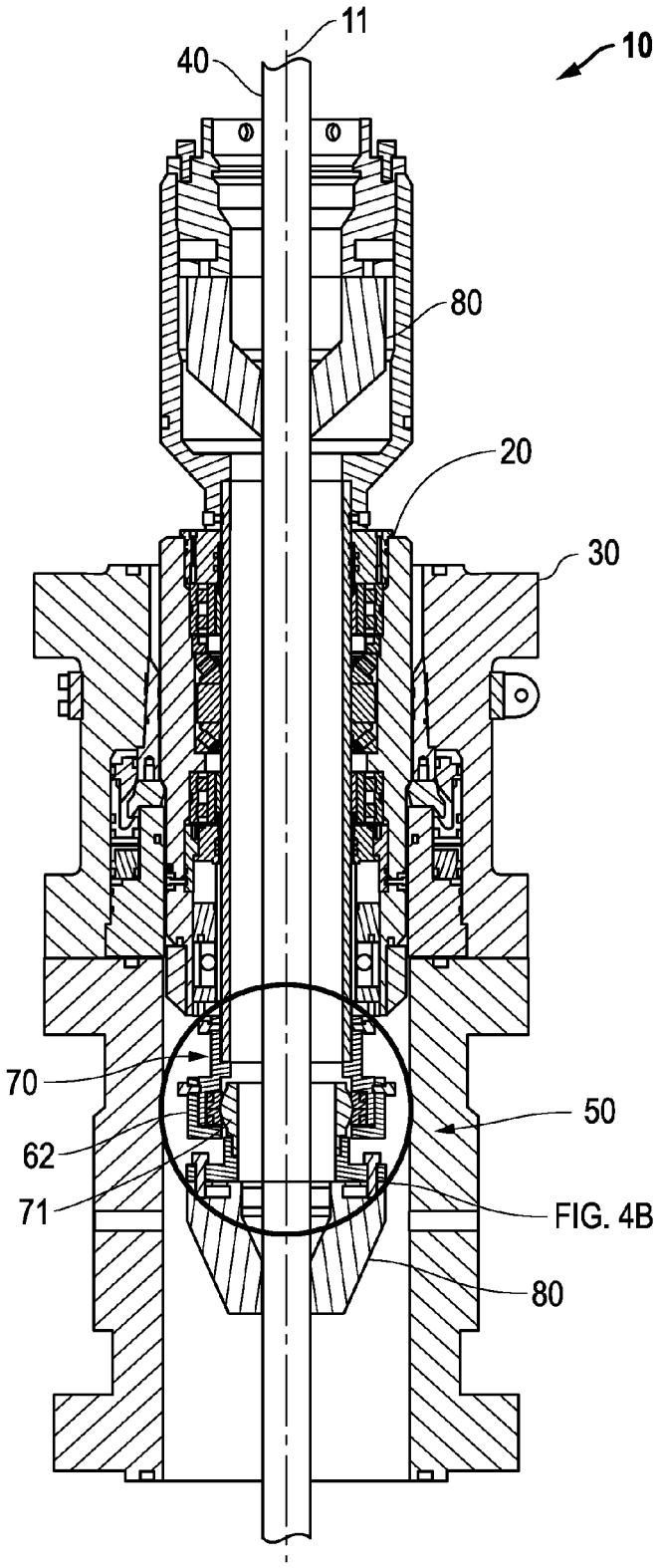
FIG. 4A depicts a cross-section of an RCD with an alternate exemplary embodiment of a misalignment correction device with a carrier, floating joint, and thrust bearings.
Figure 4B:
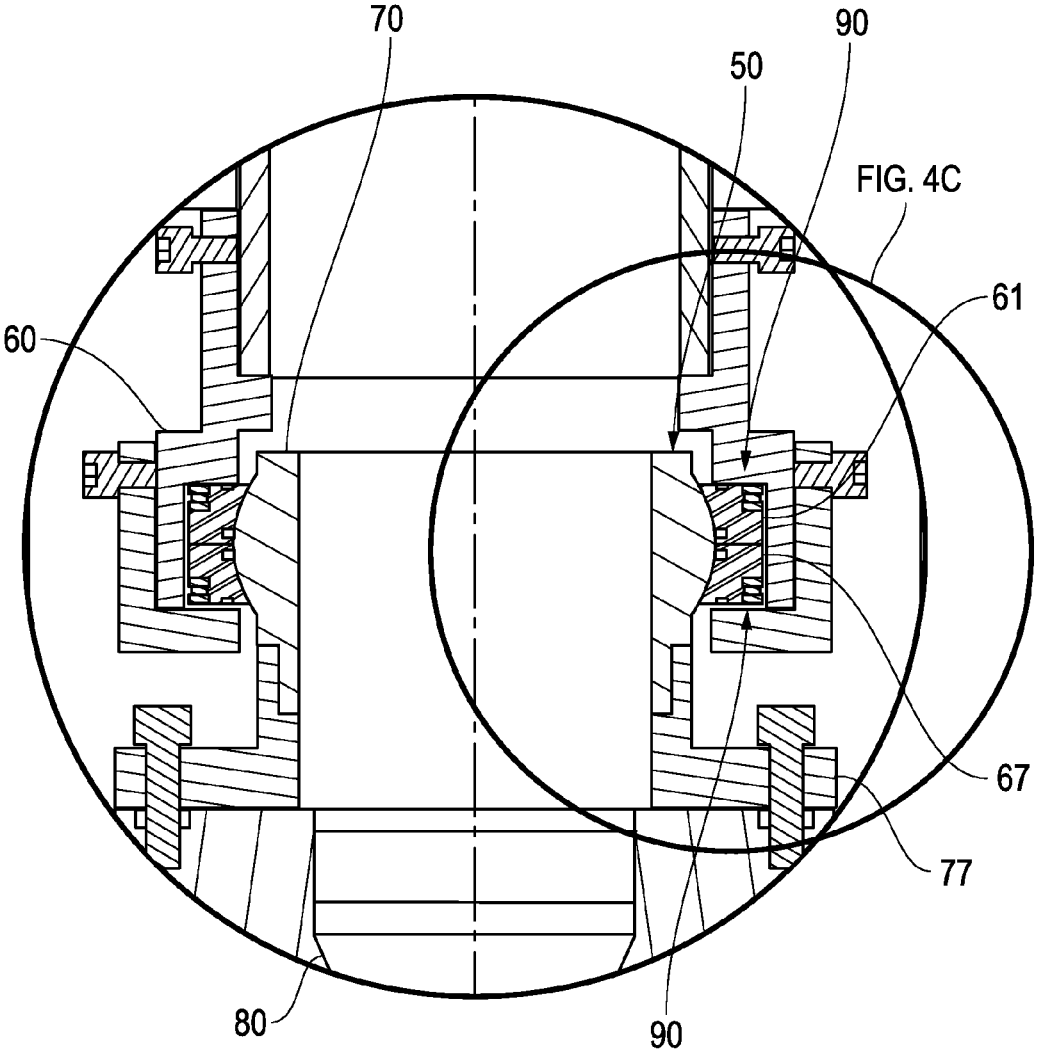
FIG. 4B depicts an enlarged view taken from FIG. 4A.
Figure 4C:
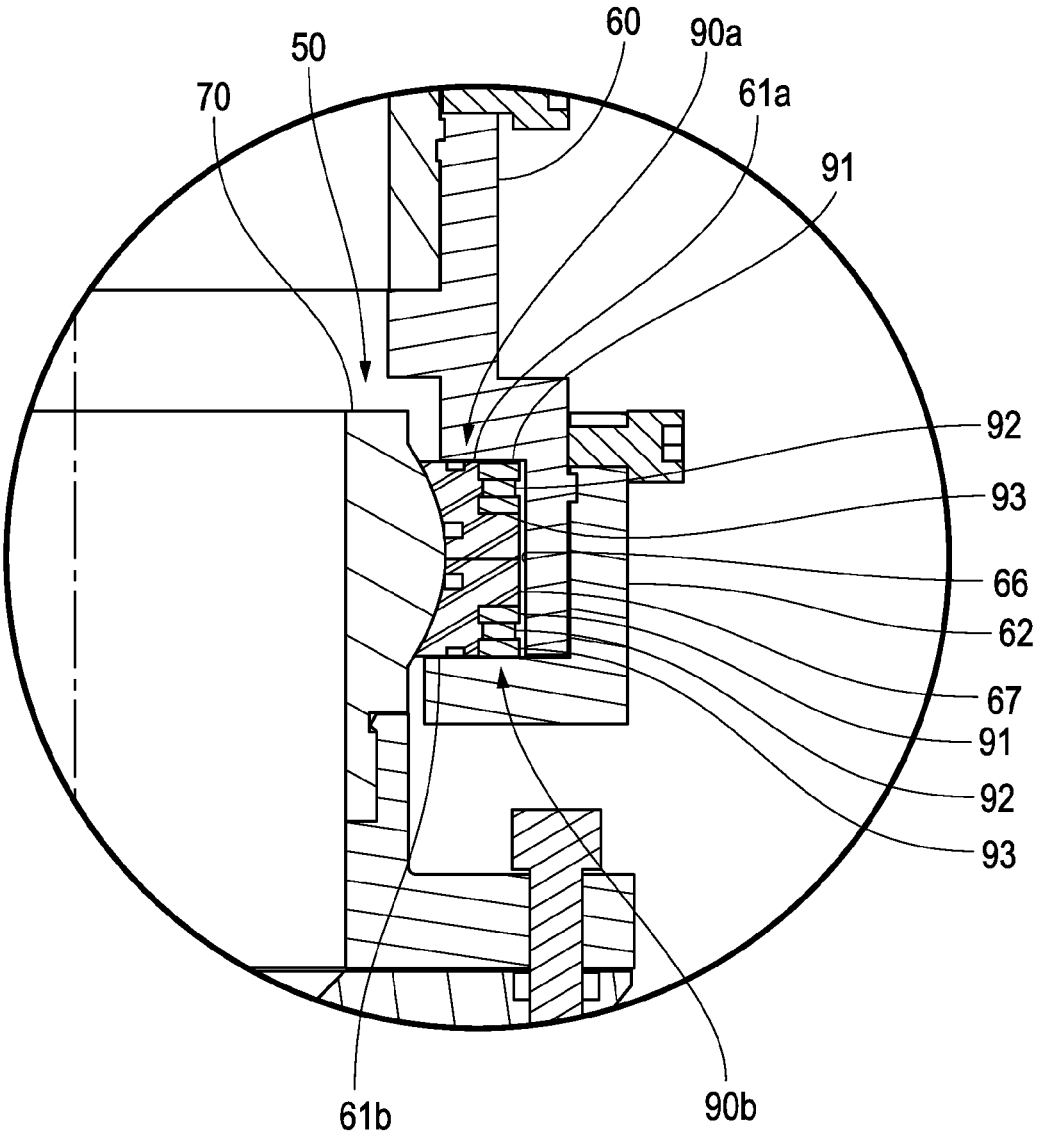
FIG. 4C depicts an enlarged view taken from FIG. 4B.

The exemplary embodiment of the misalignment correction device 50 shown in FIGS. 3A-C may optionally further include one or more thrust bearings 90 (depicted in FIGS. 4A-C). For convenience, components in FIGS. 4A-C that are similar to components in prior figures will be labeled with the same number indicator. As illustrated, there are two thrust bearings 90 in the exemplary embodiment of FIGS. 4A-C: one thrust bearing 90*a* installed between the upper plate 61*a* and the housing interior wall 66, and one thrust bearing 90*b* installed between the lower plate 61*b* and the housing interior wall 66; however, it should be appreciated that any number of thrust bearings 90 may be installed between the plates 61 and the housing 62. In alternate exemplary embodiments, the thrust bearings 90 may be installed elsewhere on or within the RCD 10.

Each of the thrust bearings 90 incorporates a fixed ring 91, a sliding or movable ring 93 and bearings 92 between the rings 91 and 93. The fixed ring 91 is attached or mounted to the housing 62. The sliding or movable ring 93 is attached to the plates 61, and may slide radially or horizontally into and out of chamber 67 in response to plates 61 shifting towards or away from the axis 11. The bearings 92 sit in between the rings 91, 93 and may be any suitable type of rolling type bearings including but not limited to: balls, cylindrical rollers, spherical rollers, tapered rollers, and needle rollers. The thrust bearings 90 enable the plates 61 to more easily slide or shift in compensating for any horizontal misalignment and also help to minimize damage to the RCD 10, bearing assembly 20, latch assembly 30 and piece of oilfield equipment 40.

Figure 5A:
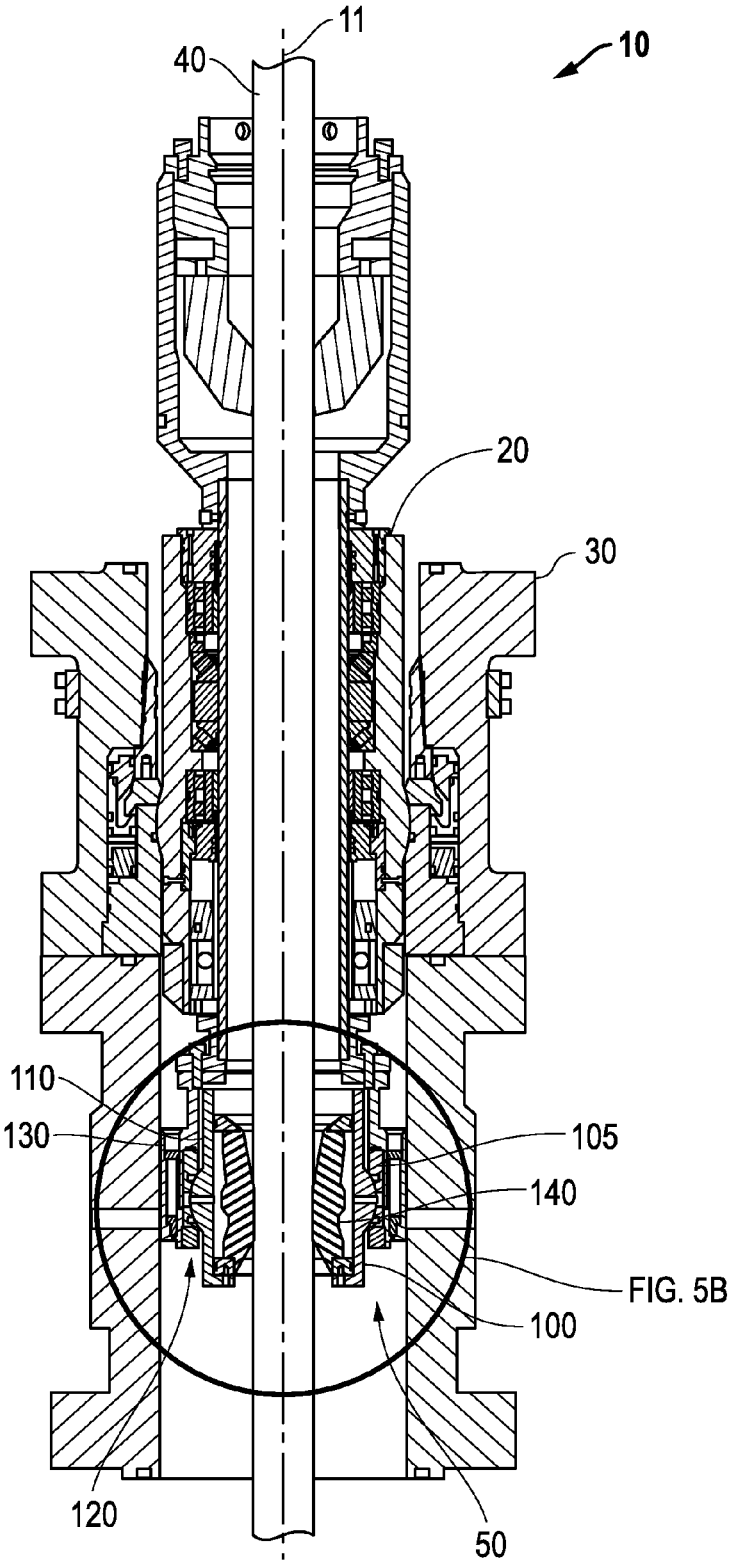
FIG. 5A depicts a cross-section of an RCD with an alternate exemplary embodiment of a misalignment correction device with a carrier, floating joint, and pressure reduction system.
Figure 5B:
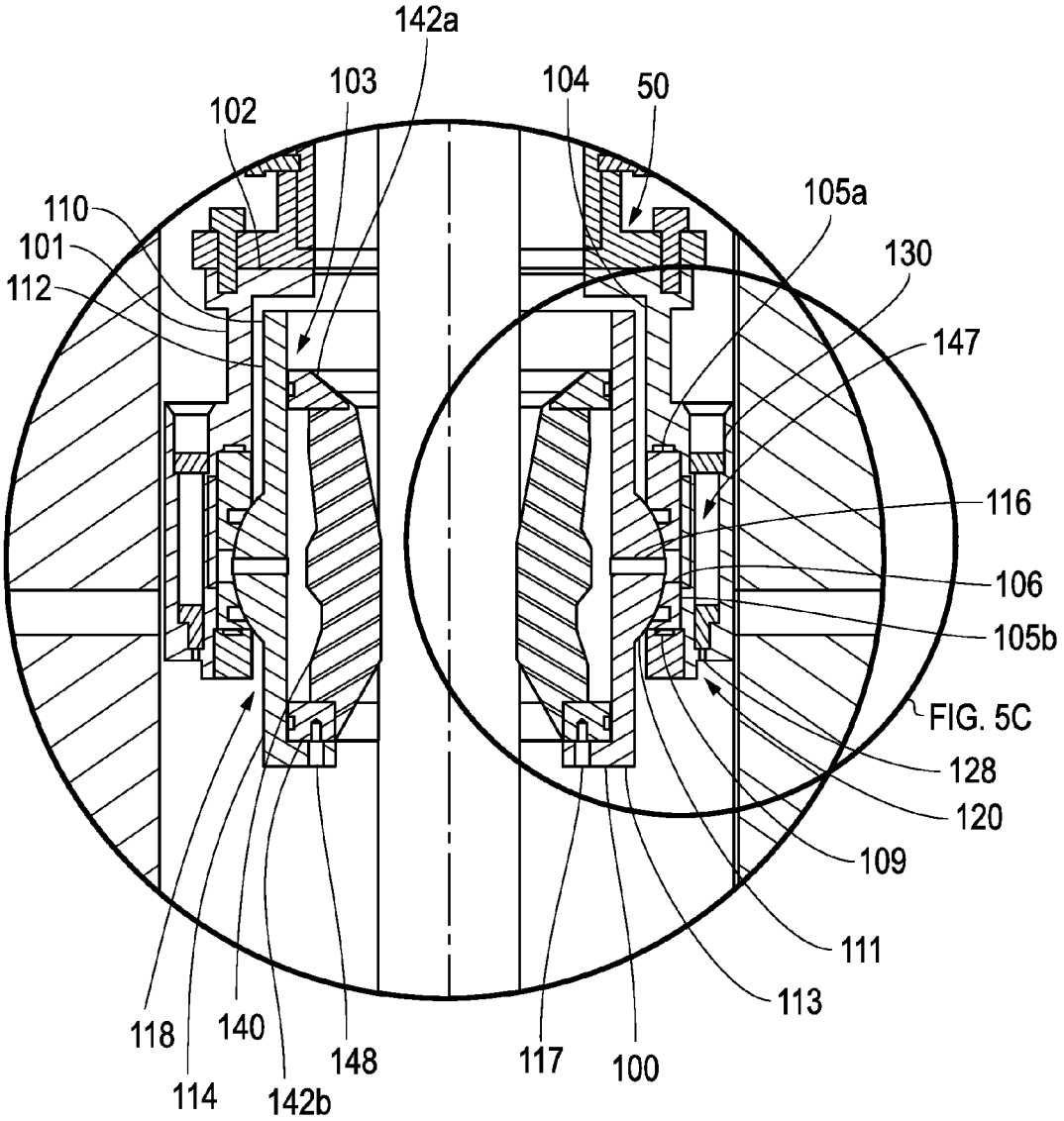
FIG. 5B depicts an enlarged view taken from FIG. 5A.
Figure 5C:
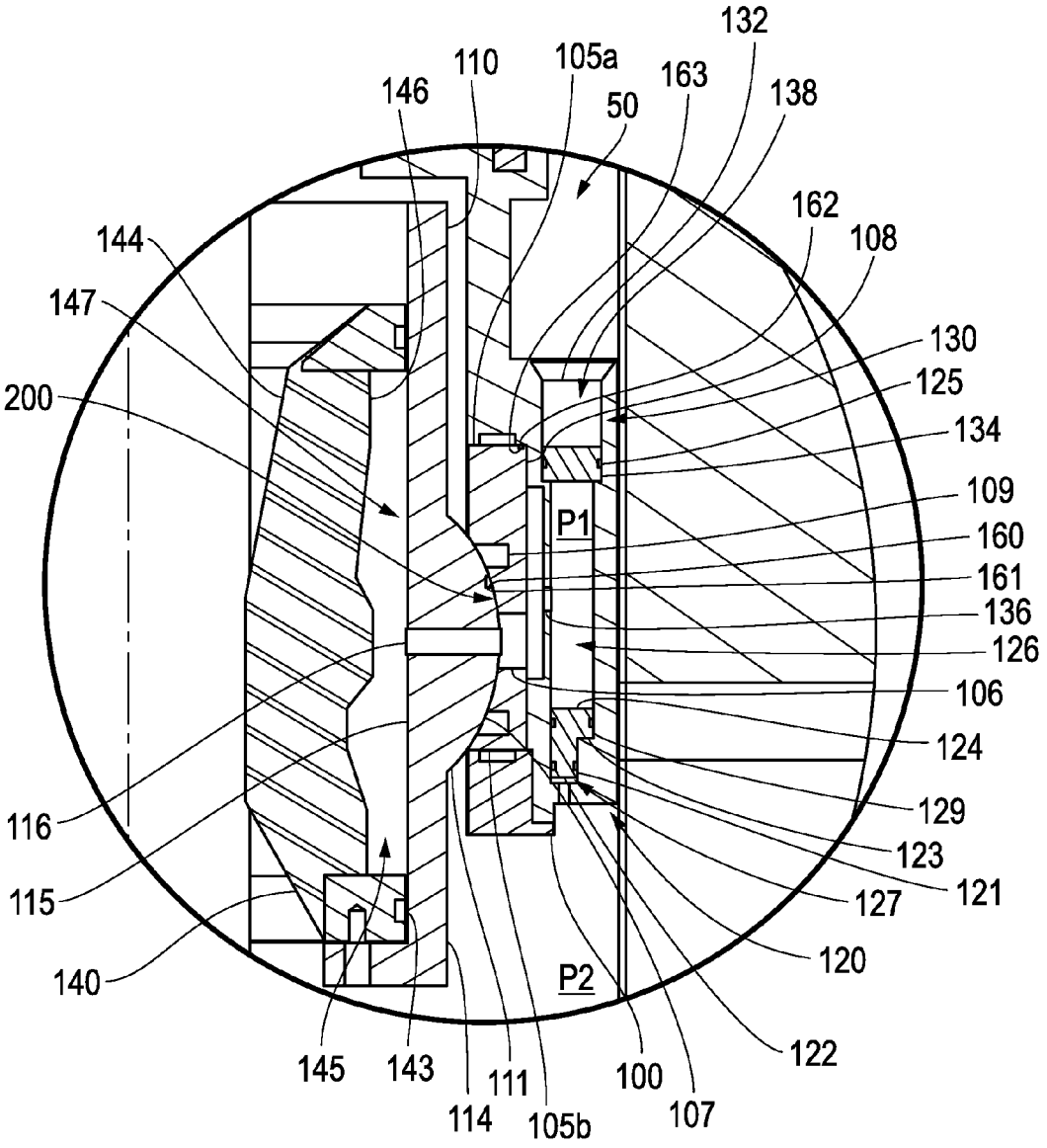
FIG. 5C depicts an enlarged view taken from FIG. 5B.

FIGS. 5A-C depict a cross-section of an RCD 10 with an alternate exemplary embodiment of a misalignment correction device 50 with a carrier 100, floating joint 110, and pressure reduction system 120. The exemplary embodiment of the misalignment correction device 50 in FIGS. 5A-C may be located above, below or within the bearing assembly 20 of RCD 10. The carrier 100 has a cylindrical wall 101 surrounding a chamber 103 within to allow for the retention and support of the floating joint 110, sealing element 140 and a piece of oilfield equipment 40. Further, the carrier 100 may have an end cap or collar 102 through which the carrier 100 may be attached or mounted to the bearing assembly 20. The cylindrical wall 101 of carrier 100 is constructed to retain the plates 105, the pressure reduction system 120 and an optional nitrogen accumulator 130.

The plates 105 may include any number of plates, but in FIGS. 5A-C are shown as an upper plate 105*a* and a lower plate 105*b*. Plates 105 may have an inner surface 107 and an outer surface 108. The inner surface 107 of plates 105 are machined into a socket shape profile 200 to engage the spherical shoulder 111 of the floating joint 110. The outer surface 108 may also define one or more slots 163 into which keys 162, as defined on the carrier wall 104, may engage. Optionally, as anti-rotational device(s) 190, the inner surface 107 may also define one or more keys 160, which extend into and engage with slots 161 as defined on the spherical shoulder 111. An exemplary embodiment of one such anti-rotational device 190 may be similar to that as seen in FIGS. 8A and 8B as described above. A port 106 is defined between the upper plate 105*a* and lower plate 105*b*, and is configured to allow the flow of a fluid to pass therethrough to the pressure reduction system 120. The plates 105, further, may include seals 109 to sealingly engage the top and bottom surfaces of plates 105 that are adjacent to the carrier 100 and the inner surface 107 adjacent to the spherical shoulder 111 of floating joint 110.

The floating joint 110 may be constructed of multiple parts, such as an upper piece 112 and a lower piece 113. However, it should be appreciated that the floating joint 110 may also be a singular, unitary piece, or any number of pieces, so long as the features described for both the upper piece 112 and lower piece 113 are present. The floating joint 110 has an exterior surface 114 defining a rounded, spherical shoulder 111. The upper piece 112 and lower piece 113 together define an inner surface 115 of the floating joint 110 as well as a port 116 between the two pieces 112, 113. The port 116 is configured to allow the flow of a fluid to pass therethrough to the pressure reduction system 120. The inner surface 115 of floating joint 110 establishes a cylindrical space, and part of chamber 103, through which the piece of oilfield equipment 40 may travel therethrough. In addition, the inner surface 115 and the outer diameter 146 of sealing element 140 may define a sealed chamber 145, in which a volume of fluid 147, such as an oil, may be contained. The one or more plurality of ports 116, 106, and 128 enable the wellbore pressure to influence the outer diameter 146 of sealing element 140. The floating joint 110 may also have an end cap or collar 117 to which sealing element 140 may be mounted, bonded or bolted to.

The spherical shoulder 111 engages with and is supported by the inner surface 107 of the plates 105. In addition, note that while the inner surface 107 of plates 105 may matingly contact the floating joint 110, the interior wall 104 of the carrier 100 does not make physical contact with the floating joint 110 while there is no misalignment. In particular, the interior wall 104 is arranged such that there is an annular space 118 between the interior wall 104 of the carrier 100 and the exterior surface 114 of the floating joint 110. The annular space 118 exists both above and below the spherical shoulder 111. This annular space 118 may be increased or decreased as desired for the needs of the particular oilfield operation.

The sealing element 140 is mounted, attached or bonded to a top ring 142*a* and a bottom ring 142*b*. While the sealing element 140 may be formed from a solid flexible material, such as an elastomer or rubber, the rings 142 may be formed from rigid or stiffer materials than the flexible material used for sealing element 140, such as a metal. Top ring 142*a* and bottom ring 142*b* may have fluid-tight seals 143 adjacent to the floating joint 110. Further, sealing element 140 may have an inner diameter 144, which seals against the piece of oilfield equipment 40, and an outer diameter 146. Sealing element 140, carrier 100 and floating joint 110 together delineate the chamber 103 through which a piece of oilfield equipment 40 may travel therethrough. In the exemplary embodiment depicted in FIGS. 5A-C, the bottom ring 142*b* of sealing element 140 is in a fixed position relative to the floating joint 110. The bottom ring 142*b* is fixed to floating joint 110 through attaching or mounting to the floating joint 110 using conventional means such as screws, pins or bolts 148 or bonding. The top ring 142*a* may float or shift uphole and downhole in response to the piece of oilfield equipment 40 being stripped in or out of the RCD 10. In alternate exemplary embodiments, the top ring 142*a* may be in a fixed position relative to floating joint 110 and the bottom ring 142*b* may float; both rings 142*a*, 142*b* may float; or both rings 142*a*, 142*b* may be fixed.

Adjacent to the plates 105, and also housed within the cylindrical wall 101, is the pressure reduction system 120, and optionally, a nitrogen accumulator 130. Pressure reduction system 120 is in communication with the wellbore and supplies fluid to the RCD 10. The pressure reduction system 120 typically includes a piston assembly 129, an upper chamber 126 and a lower chamber 127. The piston assembly 129 includes a smaller piston 121 and a larger piston 123. The smaller piston 121 has a relatively smaller surface area 122 as compared to the larger piston 123 which has a relatively larger surface area 124. The pressure in upper chamber 126 and chamber 145 is labeled as P1. The pressure in the lower chamber 127, as well as the pressure of the wellbore (or other system pressure), is labeled as P2. The pistons 121 and 123 are constructed and arranged to maintain a pressure differential between the P1 and P2. In other words, the pistons 121 and 123 are designed with a specific surface area ratio between surface areas 122 and 124 to maintain about a pressure differential, for example, of 1000 psi (or 6894.75 kPa), between the chambers 145, 126 and the wellbore pressure (in other words, between P1 and P2) thereby allowing the P1 to be 1000 psi lower than P2. Additionally, a plurality of seal members 125 may be disposed around the pistons 121 and 123 to form a fluid tight seal between the chambers 126 and 127.

The pressure reduction system 120 is also in fluid communication with a compensator such as a nitrogen accumulator 130. The nitrogen accumulator 130 may include a nitrogen chamber 132 and a nitrogen piston 134. Additionally, one or more seal members 125 may be disposed around the nitrogen piston 134 to form a fluid tight seal between the chambers 126 and 132. If P1 in chambers 145, 126 fluctuates, as when filling the chamber 126 with oil and/or when the sealing element 140 deforms, the nitrogen piston 134 may adjust into or out of nitrogen chamber 132 to allow for a margin of error to maintain a seal around the piece of oilfield equipment 40. Nitrogen chamber 132 may be filled with a pressure controlled volume of gas 138, such as a nitrogen gas, as would be known to one having ordinary skill in the art. In this exemplary embodiment, a pressure transducer (not shown) measures the wellbore pressure P2 and subsequently injects nitrogen into the chamber 132 at the same pressure as pressure P2. The pressure in the nitrogen chamber 132 may be adjusted as the wellbore pressure P2 changes, thereby maintaining the desired pressure differential, for example, of 1000 psi, between pressure P1 and wellbore pressure P2.

The pressure reduction system 120 provides reduced pressure from the wellbore to activate the sealing element 140 to seal around the piece of oilfield equipment 40. Initially, a volume of fluid 147, such as oil, is filled into upper chamber 126 and is thereafter sealed. The wellbore fluid from the wellbore is in fluid communication with lower chamber 127 through port 128 in the carrier 100. Therefore, as the wellbore pressure increases, pressure P2 in the lower chamber 127 increases. The pressure in the lower chamber 127 causes the pistons 121 and 123 to move axially upward forcing fluid in the upper chamber 126 to enter ports 136, 106, 116 and pressurize the chamber 145. As the chamber 145 fills with the oil, the pressure P1 in the chamber 145 and upper chamber 126 increases causing the sealing element 140 to move radially inward to seal around the piece of oilfield equipment 40. In this manner, the sealing element 140 is indirectly activated by the wellbore pressure, allowing the RCD 10 to seal around a piece of oilfield equipment 40. However, because the pressure reduction system 120 acts to reduce pressure P2 to a reduced pressure P1 in the chambers 145 and 126, the sealing element 140 experiences a reduced pressure load for closing against oilfield equipment 40. Thus, for example, while a sealing element 140 may be rated for 2500 psi wellbore pressure P2, the sealing element may only need to carry 1500 psi closing pressure P1. The reduced pressure on the sealing element 140 extends the usable lifetime of the sealing element 140.

In FIGS. 5A-C, the spherical shoulder 111 and matching inner surface 107 of the plates 105 allow for some rotation about axis 11 to compensate for rotational or angular misalignment between the RCD 10, bearing assembly 20, latch assembly 30 and piece of oilfield equipment 40. The amount of rotational or angular misalignment that the misalignment correction device 50 is able to compensate for is limited by the clearance or distance defined by annular space 118 between the interior wall 104 of the carrier 100 and the exterior surface 114 of the floating joint 110. Annular space 118 may be increased or decreased as desired for the certain oilfield operation at hand. The compensated misalignment increases the lifespan of sealing element 140 and helps to avoid damage to bearing assemblies 20 and RCDs 10. Further the keys 160, 162 engaging the slots 161, 163 may increase the robustness of the connection, inhibit rotation/spinning, and decrease friction and wear between the piece of the floating joint 110, carrier 100, and the plates 105.

Figure 6A:
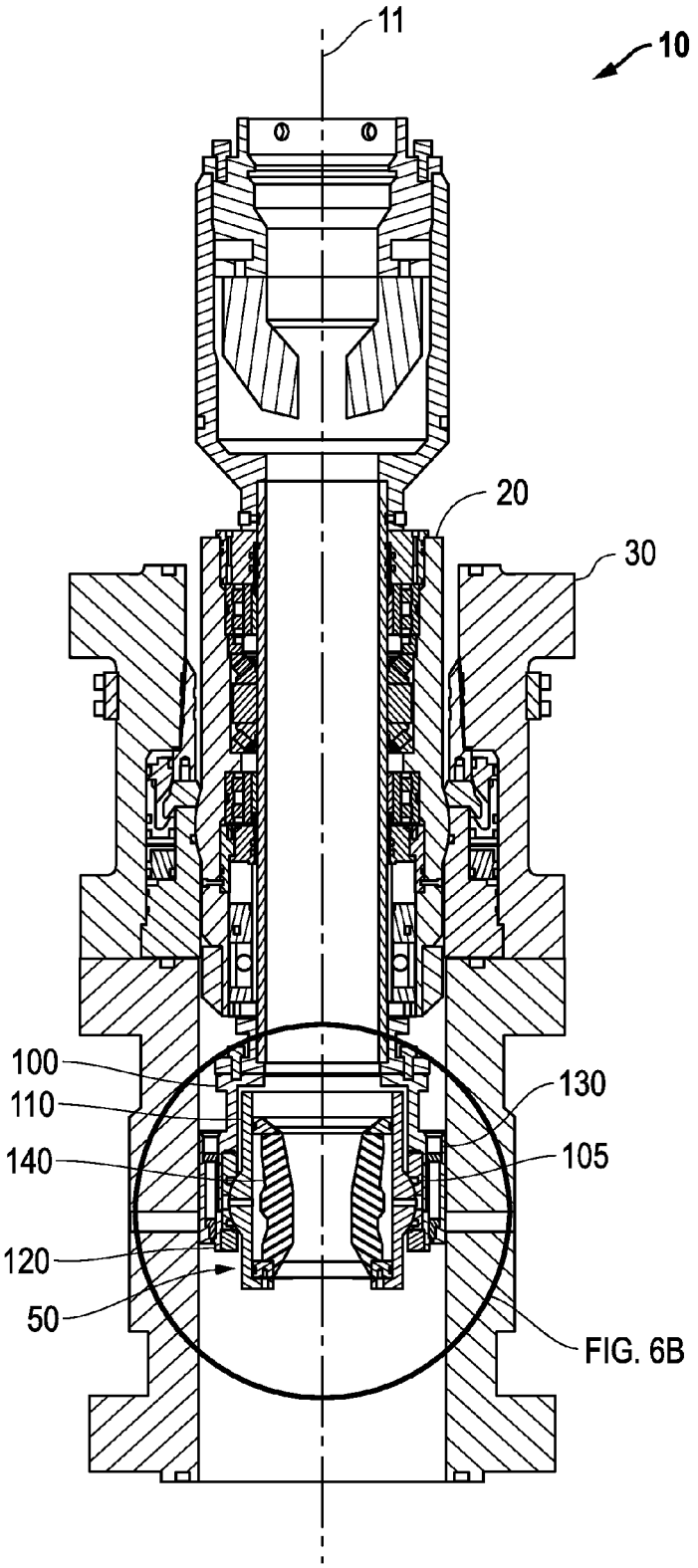
FIG. 6A depicts a cross-section of an RCD with an alternate exemplary embodiment of a misalignment correction device with a carrier, floating joint, pressure reduction system, and thrust bearings.
Figure 6B:
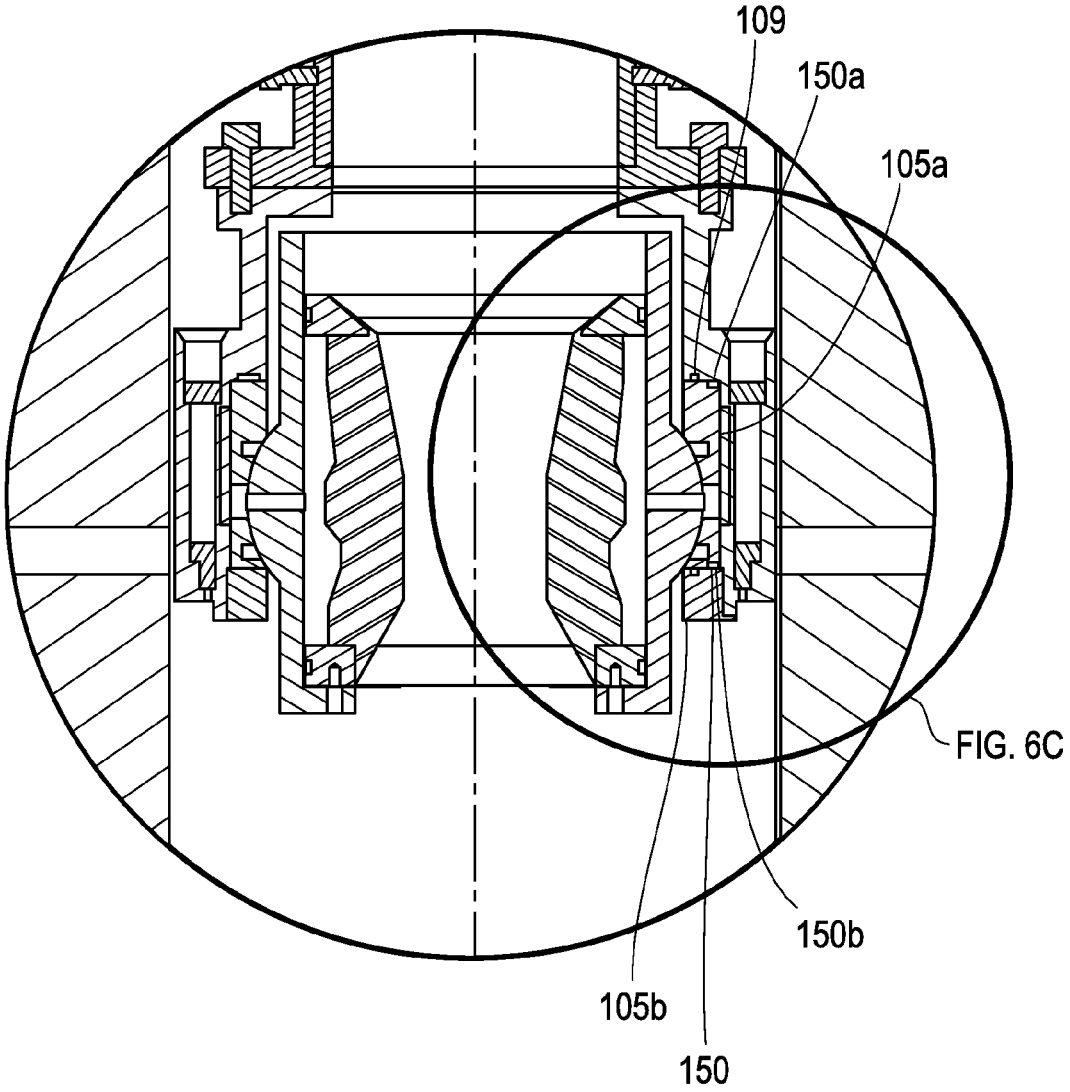
FIG. 6B depicts an enlarged view taken from FIG. 6A.
Figure 6C:
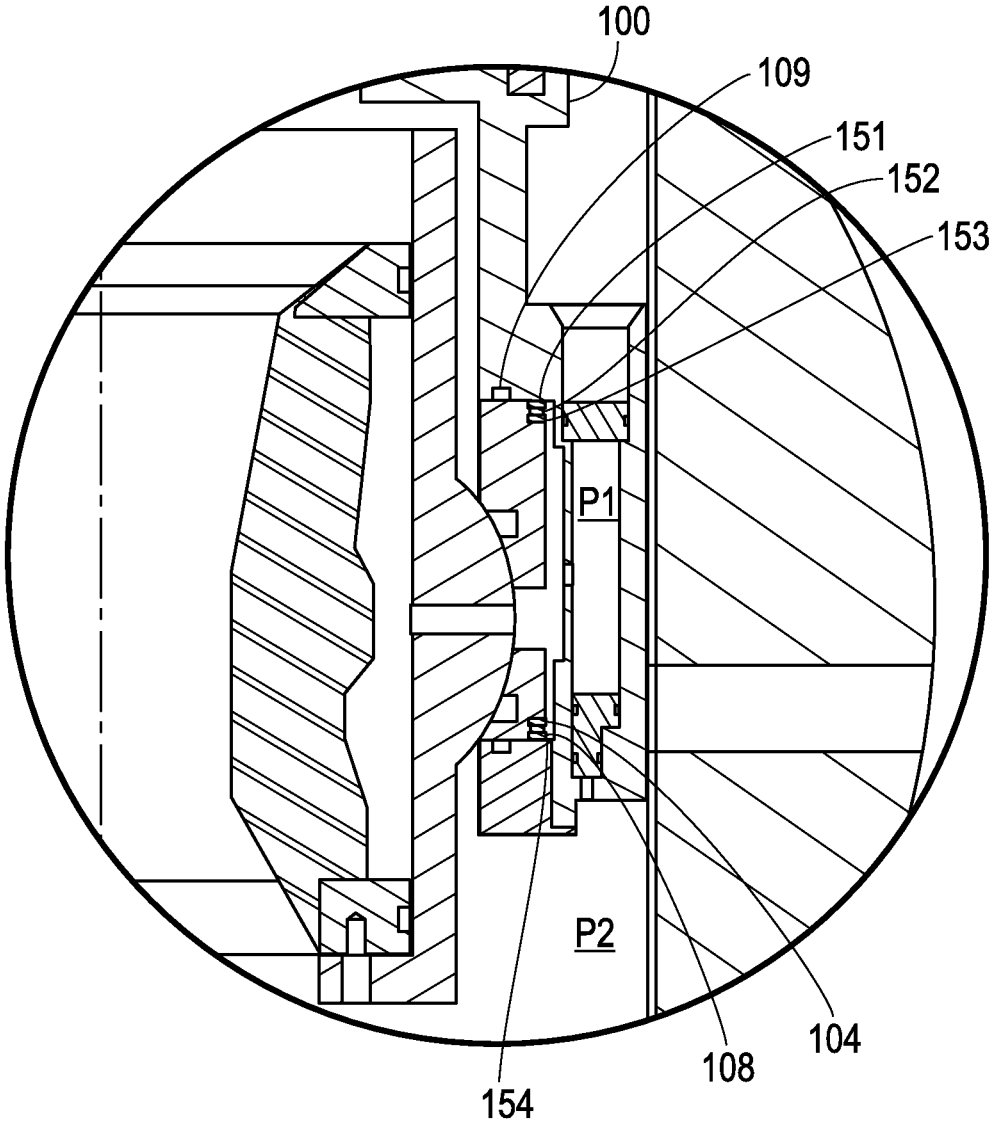
FIG. 6C depicts an enlarged view taken from FIG. 6B.

The exemplary embodiment of the misalignment correction device 50 shown in FIGS. 5A-C may optionally further include one or more thrust bearings 150 (depicted in FIGS. 6A-C). For convenience, components in FIGS. 6A-C that are similar to components in prior figures will be labeled with the same number indicator. As illustrated, there are two thrust bearings 150 in the exemplary embodiment of FIGS. 6A-C: one thrust bearing 150*a* installed between the upper plate 105*a* and the carrier interior wall 104, and one thrust bearing 150*b* installed between the lower plate 105*b* and the carrier interior wall 104; however, it should be appreciated that any number of thrust bearings 150 may be installed between the plates 105 and the carrier 100. In the exemplary embodiment depicted in FIGS. 6A-C the outer surface 108 of the plates 105 does not fully sit flush against the interior wall 104 of the carrier 100. Instead, the outer surface 108 of the plates 105 forms a chamber 154 with interior wall 104 of the carrier 100.

Each of the thrust bearings 150 incorporates a fixed ring 151, a sliding or movable ring 153 and bearings 152 between the rings 151 and 153. The fixed ring 151 is attached or mounted to the carrier 100. The sliding or movable ring 153 is attached to the plates 105, and may slide radially or horizontally into and out of chamber 154 in response to plates 105 shifting towards or away from the axis 11. The bearings 152 sit in between the rings 151, 153 and may be any suitable type of rolling type bearings including but not limited to: balls, cylindrical rollers, spherical rollers, tapered rollers, and needle rollers. The thrust bearings 150 enable the plates 105 to more easily slide or shift in compensating for any horizontal misalignment and also help to minimize damage to the RCD 10, bearing assembly 20, latch assembly 30 and piece of oilfield equipment 40.

Figure 7:
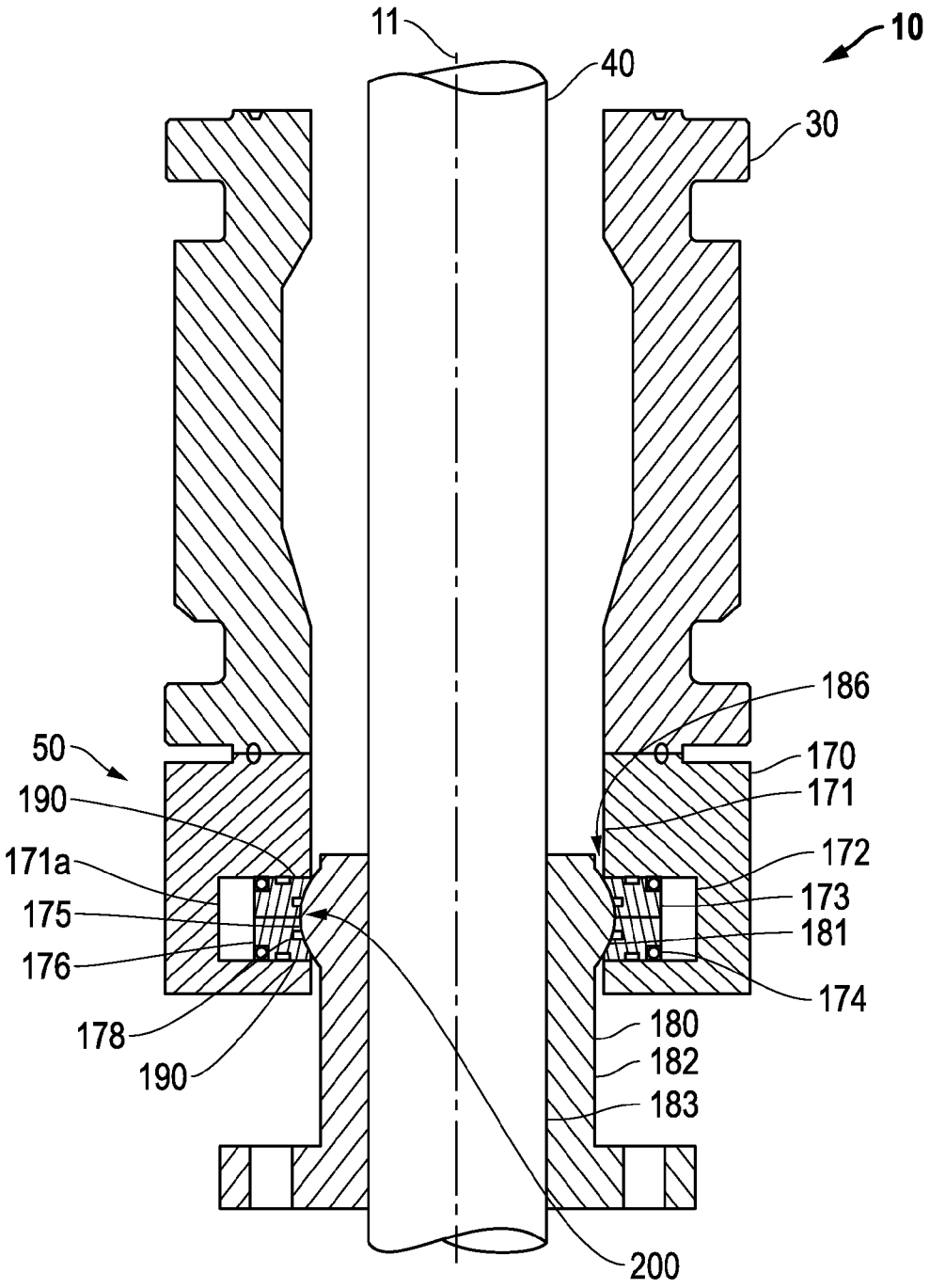
FIG. 7 depicts a cross-section of an RCD and spool with an alternate exemplary embodiment of a misalignment correction device with a floating joint.

FIG. 7 depicts a cross-section of an RCD 10 with an alternate exemplary embodiment of a misalignment correction device 50 with a floating joint 180 and spool 170. As shown, the spool 170 is mounted below the RCD 10, but in another exemplary embodiment, may be elsewhere (such as above) the RCD 10, and alternatively, may be mounted proximate but not necessarily abutting the RCD 10. The spool 170 has an interior wall 171 defining a chamber 172 within which one or more plates 173 are housed. Further, the exemplary embodiment may optionally include one or more thrust bearings 174 at the interface where the plates 173 lie adjacent to the interior wall 171.

The outer surface 176 of the plates 173 do not sit fully flush against the interior wall 171*a*. The inner surface 175 of the plates 173 are machined into a socket shape profile 200 to engage the spherical shoulder 181 of floating joint 180. The plates 173, further, may include seals 178 to sealingly engage the top and bottom surfaces of plates 173 that are adjacent to the spool 170 and the inner surface 115 adjacent to the spherical shoulder 181 of floating joint 180.

The floating joint 180 has an exterior surface 182 defining a rounded, spherical shoulder 181. The inner surface 183 of floating joint 180 establishes a cylindrical space through which the piece of oilfield equipment 40 may travel therethrough.

The spherical shoulder 181 engages with and is supported by the inner surface 175 of the plates 173. In addition, note that while the inner surface 175 of plates 173 may matingly contact with floating joint 180, the interior wall 171 of the spool 170 does not contact the floating joint 180 while there is no misalignment. In particular, the interior wall 171 is arranged such that there is an annular space 186 between the interior wall 171 of the spool 170 and the exterior surface 182 of the floating joint 180. This annular space 186 may be increased or decreased as desired for the needs of the particular oilfield operation, and may exist above and below the spherical shoulder 181. In addition anti-rotational devices 190, such as or similar to the exemplary embodiment of anti-rotational device 190 depicted in FIGS. 8A-8B as described above, may be included between the floating joint 180 and the plates 173, and/or between the plates 173 and the spool 170.

The exemplary embodiment depicted in FIG. 7 allows some rotation and radial movement about axis 11 to compensate for some rotational and horizontal misalignment between the RCD 10, latch assembly 30, bearing assembly 20 (not shown in FIG. 7), spool 170, and piece of oilfield equipment 40. Thrust bearings 174 may also be installed to help alleviate horizontal misalignment present in RCD 10 beyond the limits of the annular space 186 and chamber 172.

Figure 9C:
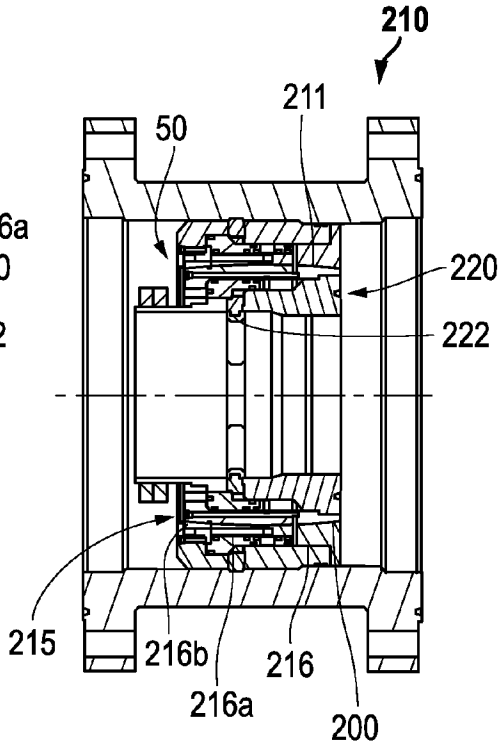
FIG. 9C depicts a cross-section taken along line 9C-9C of FIG. 9A of an RCD receiver with an exemplary embodiment of a misalignment mitigation or correction device.
Figure 9B:
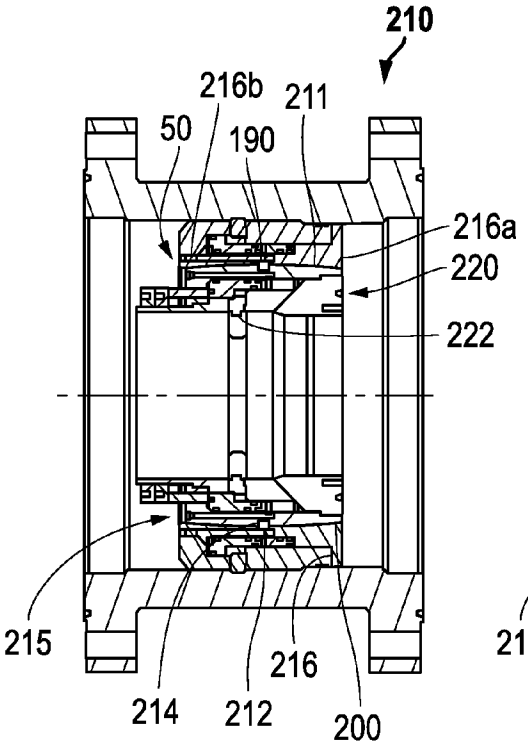
FIG. 9B depicts a cross-section taken along line 9B-9B of FIG. 9A of an RCD receiver with an exemplary embodiment of a misalignment mitigation or correction device.
Figure 9A:
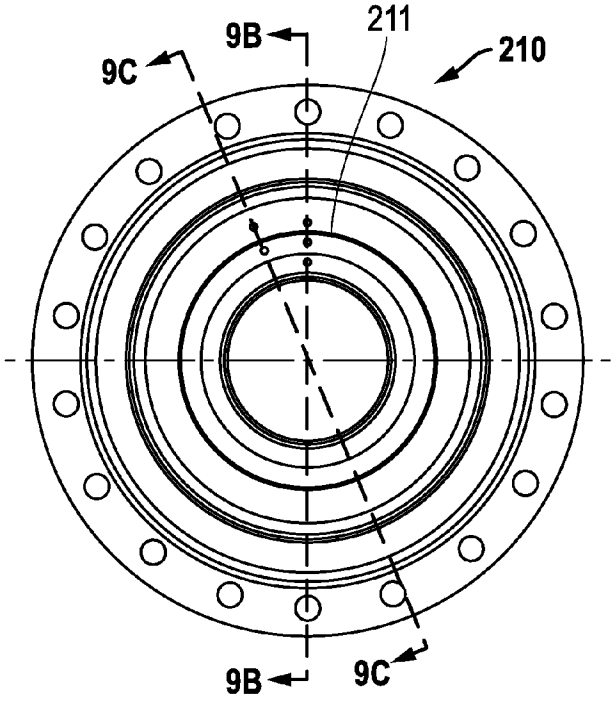
FIG. 9A depicts an end view of an RCD receiver with an exemplary embodiment of a misalignment mitigation or correction device for locating internal oilfield equipment such as a bearing.

FIG. 9A depicts an end view of an RCD receiver/fitting 210 with an exemplary embodiment of a misalignment mitigation or correction device 50 for locating and/or placing internal oilfield equipment such as a bearing assembly (not shown). FIG. 9B is a cross-section of FIG. 9A, taken along line 9B-9B and FIG. 9C is a cross-section of FIG. 9A, taken along line 9C-9C. The RCD receiver 210 includes a floating joint 215 having a spherical shoulder 211. A corresponding surface in the shape of a socket shape profile 200 is defined by an annular piece 216. The annular piece 216 may be comprised of two ring-like pieces, a primary annular piece 216*a* and a secondary annular piece 216*b*, of which the secondary annular piece 216*b* may be relatively smaller in size as compared to the primary annular piece 216*a*. The inner surface of the two pieces 216*a* and 216*b* together may form the socket shape profile 200. The exemplary embodiment of the RCD receiver 210 may include an anti-rotational device 190. As is seen in FIG. 9B, the exemplary embodiment of the RCD receiver 210 may include a locking dog 212 and a profile 214. In addition to a locking functionality, the locking dog 212 and profile 214 together may also have the functionality of an anti-rotational device 190. An inner annular member 220 may include an inward latching mechanism 222 (or profile). The exemplary embodiment as depicted in FIGS. 9A-C may be utilized to minimize misalignment when the operator requires the location and/or retrieval of internal oilfield equipment. Further, the anti-rotational devices 190 may reduce and/or inhibit unintentional rotation or spinning within the RCD receiver 210 or relative internals as the internal oilfield equipment is located.

While the exemplary embodiments are described with reference to various implementations and exploitations, it will be understood that these exemplary embodiments are illustrative and that the scope of the disclosed subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the disclosed subject matter.

What is claimed is:

1. A misalignment correction device for mitigating misalignment of a piece of oilfield equipment in or proximate a rotating control device (RCD), comprising:

a rounded shoulder on a first surface of the misalignment correction device;

a socket profile on a second surface of the misalignment correction device, wherein the rounded shoulder is configured to abut the socket profile, and further wherein the rounded shoulder is configured to rotate within the socket profile to compensate for angular misalignment between the RCD and the piece of oilfield equipment;

one of the group consisting of a key and a slot defined on the rounded shoulder; and the other of the group consisting of the key and the slot defined on the socket profile, wherein the key is configured to engage the slot, and further wherein engagement between the key and the slot inhibits relative rotation between the rounded shoulder and the socket profile about a longitudinal axis of the piece of oilfield equipment.

2. The apparatus according to claim 1, further comprising a bearing assembly, a seal element support or a receiver having an exterior surface, wherein the first surface is defined on the exterior surface of the respective bearing assembly, seal element support or receiver.

3. The apparatus according to claim 2, further comprising a latch assembly having an annular piece defining an interior surface surrounding the bearing assembly, wherein the socket profile is defined on the interior surface of the annular piece.

4. The apparatus according to claim 1, further comprising:

a bearing assembly within the RCD; and a sleeve having an inside surface and an outside surface, wherein the inside surface is joined to the bearing assembly, and further wherein the spherical shoulder is defined on the outside surface of the sleeve.

5. The apparatus according to claim 1, further comprising one or more thrust bearings within the RCD.

6. A misalignment correction device for mitigating misalignment of a piece of oilfield equipment in or proximate a rotating control device (RCD), comprising:

a rounded shoulder on a first surface within or proximate the RCD;

a socket profile on a second surface within or proximate the RCD, wherein the second surface is configured to abut the rounded shoulder, and further wherein the rounded shoulder is configured to rotate within the socket profile; and a floating joint having an outer surface within the RCD, wherein said floating joint is configured to shift to compensate for misalignment.

7. The apparatus according to claim 6, wherein said floating joint is configured to shift horizontally within the RCD.

8. The apparatus according to claim 7, wherein said floating joint is further configured to shift uphole and downhole within the RCD.

9. The apparatus according to claim 6, wherein said floating joint is further configured to shift uphole and downhole within the RCD.

10. The apparatus according to claim 6, further comprising one or more plates having an inner surface within the RCD, wherein the second surface is defined on the inner surface of the plates.

11. An apparatus for correction of misalignment of a piece of oilfield equipment within a rotating control device (RCD), comprising:

a misalignment correction device, wherein at least part of the piece of oilfield equipment is located within the misalignment correction device;

a spherical shoulder on a first surface of the misalignment correction device;

a socket defined on a second surface of the misalignment correction device, wherein the socket is configured to engage the spherical shoulder;

a sealing element having an internal diameter and an external diameter, wherein the internal diameter is configured to seal against the piece of oilfield equipment; and a pressure reduction system, wherein the pressure reduction system comprises a piston assembly configured to reduce a wellbore pressure to a reduced pressure experienced by the external diameter of the sealing element.

12. The apparatus according to claim 11, further comprising: one or more plates having an interior surface and an exterior surface within the misalignment correction device, wherein the second surface upon which the socket is defined is the interior surface of the one or more plates.

13. The apparatus according to claim 12, further comprising a floating joint, wherein said floating joint is configured to shift radially to compensate for horizontal misalignment between the RCD and the piece of oilfield equipment.

14. The apparatus according to claim 13, wherein said floating joint is further configured to shift uphole and downhole within the RCD.

15. The apparatus according to claim 13, further comprising:

a carrier configured to house the one or more plates and the floating joint; and a chamber defined within the carrier and located adjacent to the exterior surface of the one or more plates, wherein the one or more plates are configured to move in and out of the chamber in response to the horizontal misalignment between the RCD and the piece of oilfield equipment.

16. The apparatus according to claim 15, wherein the one or more plates include a key which is configured to engage a slot defined on the spherical shoulder.

17. The apparatus according to claim 16, further comprising a thrust bearing adjacent to the one or more plates.

18. The apparatus according to claim 15, wherein the carrier includes a key which is configured to engage a slot defined on the exterior surface of the one or more plates.

19. The apparatus according to claim 11, wherein the misalignment correction device is located on a spool mounted below the RCD.

20. A method for correction of misalignment of a piece of oilfield equipment within a rotating control device (RCD), comprising the steps of:

housing part of the piece of oilfield equipment within a misalignment correction device proximate a bearing assembly; and correcting the misalignment, comprising shifting the misalignment correction device horizontally in response to horizontal misalignment between the RCD and the piece of oilfield equipment; and limiting the horizontal shifting of the misalignment correction device.

21. The method according to claim 20, in which the step of correcting the misalignment further comprises: rotating the misalignment correction device in response to angular misalignment between the RCD and the piece of oilfield equipment; and limiting the rotation of the misalignment correction device.

22. The method according to claim 20, further comprising the step of: shifting the misalignment correction device uphole and downhole in response to movement of the piece of oilfield equipment.

23. The method according to claim 20, wherein said step of shifting the misalignment correction device further comprises the step of: shifting a plate horizontally into a chamber.

24. The method according to claim 23, further comprising the step of: preventing the misalignment correction device from spinning.

25. The method according to claim 23, further comprising the step of: preventing the plate from spinning.

26. A method for correction of misalignment of a piece of oilfield equipment within a rotating control device (RCD), comprising the steps of:

housing part of the piece of oilfield equipment within a misalignment correction device proximate a bearing assembly;

correcting the misalignment, comprising rotating the misalignment correction device in response to rotational misalignment of the piece of oilfield equipment, and limiting the rotation of the misalignment correction device; and shifting the misalignment correction device uphole and downhole in response to movement of the piece of oilfield equipment.

* * * * *